US006966775B1

(12) United States Patent
Kendir et al.

(10) Patent No.: US 6,966,775 B1
(45) Date of Patent: Nov. 22, 2005

(54) FIREARM LASER TRAINING SYSTEM AND METHOD FACILITATING FIREARM TRAINING WITH VARIOUS TARGETS AND VISUAL FEEDBACK OF SIMULATED PROJECTILE IMPACT LOCATIONS

(75) Inventors: Tansel Kendir, Eldersburg, MD (US); Motti Shechter, Potomac, MD (US)

(73) Assignee: Beamhit, LLC, Columbia, MD (US)

( * ) Notice: Subject to any disclaimer, the term of this patent is extended or adjusted under 35 U.S.C. 154(b) by 0 days.

(21) Appl. No.: 10/602,019

(22) Filed: Jun. 24, 2003

Related U.S. Application Data

(63) Continuation of application No. 09/878,786, filed on Jun. 11, 2001, now Pat. No. 6,616,452.

(60) Provisional application No. 60/210,595, filed on Jun. 9, 2000, provisional application No. 60/260,522, filed on Jan. 10, 2001.

(51) Int. Cl.[7] ..... F41G 3/26

(52) U.S. Cl. ..... 434/19; 434/21; 434/22; 463/51

(58) Field of Search ..... 434/19, 20, 21, 434/22, 23; 463/51

(56) References Cited

U.S. PATENT DOCUMENTS

| | | | |
|---|---|---|---|
| 2,023,497 | A | 12/1935 | Trammell |
| 2,934,634 | A | 4/1960 | Hellberg |
| 3,452,453 | A | 7/1969 | Ohlund |
| 3,510,965 | A | 5/1970 | Rhea |
| 3,526,972 | A | 9/1970 | Sumpf |
| 3,590,225 | A | 6/1971 | Murphy |
| 3,633,285 | A | 1/1972 | Sensney |
| 3,782,832 | A | 1/1974 | Hacskaylo |
| 3,792,535 | A | 2/1974 | Marshall et al. |
| 3,888,022 | A | 6/1975 | Pardes et al. |
| 3,938,262 | A | 2/1976 | Dye et al. |
| 3,995,376 | A | 12/1976 | Kimble et al. |
| 3,996,674 | A | 12/1976 | Pardes et al. |
| 4,048,489 | A | 9/1977 | Giannetti |
| 4,068,393 | A | 1/1978 | Tararine et al. |
| 4,102,059 | A | 7/1978 | Kimble et al. |
| 4,164,081 | A | 8/1979 | Berke |
| 4,177,580 | A | 12/1979 | Marshall et al. |
| 4,195,422 | A | 4/1980 | Budmiger |
| 4,218,834 | A | 8/1980 | Robertsson |
| 4,222,564 | A | 9/1980 | Allen et al. |
| 4,256,013 | A | 3/1981 | Quitadama |
| 4,269,415 | A | 5/1981 | Thorne-Booth |
| 4,281,993 | A | 8/1981 | Shaw |
| 4,290,757 | A | 9/1981 | Marshall et al. |
| 4,313,272 | A | 2/1982 | Matthews |
| 4,313,273 | A | 2/1982 | Matthews et al. |
| 4,336,018 | A | 6/1982 | Marshall et al. |
| 4,340,370 | A | 7/1982 | Marshall et al. |
| 4,352,665 | A | 10/1982 | Kimble et al. |
| 4,367,516 | A | 1/1983 | Jacob |

(Continued)

FOREIGN PATENT DOCUMENTS

| | | |
|---|---|---|
| CH | 204889 | 5/1939 |

(Continued)

*Primary Examiner*—Marc Norman

(57) ABSTRACT

A firearm laser training system of the present invention includes a target having a plurality of zones, a laser transmitter assembly for projecting a laser beam, a sensing device and a processor. The sensing device scans the target to produce target images to detect laser beam or simulated projectile impact locations. The processor receives impact location information from the sensing device and processes the received information to evaluate user performance and to display evaluation information and an image of the target including indicia corresponding to the detected impact locations.

28 Claims, 8 Drawing Sheets

U.S. PATENT DOCUMENTS 4,452,458 A 6/1984 Timander et al.
4,553,943 A 11/1985 Ahola et al.
4,561,849 A 12/1985 Eichweber
4,572,509 A 2/1986 Sitrick
4,583,950 A 4/1986 Schroeder
4,592,554 A 6/1986 Gilbertson
4,619,615 A 10/1986 Kratzenberg
4,619,616 A 10/1986 Clarke
4,640,514 A 2/1987 Myllyla et al.
4,657,511 A 4/1987 Allard et al.
4,662,845 A 5/1987 Gallagher et al.
4,678,437 A 7/1987 Scott et al.
4,680,012 A 7/1987 Morley et al.
4,695,256 A 9/1987 Eichweber
4,737,106 A 4/1988 Laciny
4,761,907 A 8/1988 De Bernardini
4,786,058 A 11/1988 Baughman
4,788,441 A 11/1988 Laskowski
4,789,339 A 12/1988 Bagnall-Wild et al.
4,804,325 A 2/1989 Willits et al.
4,811,955 A 3/1989 De Bernardini
4,830,617 A 5/1989 Hancox et al.
4,864,515 A * 9/1989 Deck ..... 702/142
4,898,391 A 2/1990 Kelly et al.
4,922,401 A 5/1990 Lipman
4,923,402 A 5/1990 Marshall et al.
4,934,937 A 6/1990 Judd
4,947,859 A 8/1990 Brewer et al.
4,948,371 A 8/1990 Hall
4,983,123 A 1/1991 Scott et al.
4,988,111 A 1/1991 Gerlizt et al.
5,004,423 A 4/1991 Bertrams
5,035,622 A 7/1991 Marshall et al.
5,064,988 A 11/1991 E' nama et al.
5,090,708 A 2/1992 Gerlitz et al.
5,092,071 A 3/1992 Moore
5,095,433 A 3/1992 Botarelli et al.
5,119,576 A 6/1992 Erning
5,140,893 A 8/1992 Leiter
5,153,375 A 10/1992 Eguizabal
5,179,235 A 1/1993 Toole
5,181,015 A 1/1993 Marshall et al.
5,194,006 A 3/1993 Zaenglein, Jr.
5,194,007 A 3/1993 Marshall et al.
5,213,503 A 5/1993 Marshall et al.
5,215,465 A 6/1993 Marshall et al.
5,237,773 A 8/1993 Claridge
5,281,142 A 1/1994 Zaenglein, Jr.
5,328,190 A 7/1994 Dart et al.
5,344,320 A 9/1994 Inbar et al.
5,365,669 A 11/1994 Rustick et al.
5,366,229 A 11/1994 Suzuki
5,400,095 A 3/1995 Minich et al.
5,413,357 A 5/1995 Schulze et al.
5,433,134 A 7/1995 Leiter
5,474,452 A 12/1995 Campagnuolo
5,486,001 A 1/1996 Baker
5,488,795 A 2/1996 Sweat
5,489,923 A 2/1996 Marshall et al.
5,502,459 A 3/1996 Marshall et al.
5,504,501 A 4/1996 Hauck et al.
5,515,079 A 5/1996 Hauck
5,529,310 A 6/1996 Hazard et al.
5,551,876 A * 9/1996 Koresawa et al. ..... 434/16
5,585,589 A 12/1996 Leiter
5,591,032 A 1/1997 Powell et al.
5,594,468 A 1/1997 Marshall et al.
5,605,461 A 2/1997 Seeton
5,613,913 A 3/1997 Ikematsu et al.
5,641,288 A 6/1997 Zaenglein, Jr.
5,672,108 A 9/1997 Lam et al.
5,685,636 A 11/1997 German
5,716,216 A 2/1998 O' Loughlin, et al.
5,738,522 A 4/1998 Sussholz et al.
5,740,626 A 4/1998 Schuetz et al.
5,788,500 A 8/1998 Gerber
5,842,300 A 12/1998 Cheshelski et al.
5,890,906 A 4/1999 Macri et al.
5,933,132 A 8/1999 Marshall et al.
5,947,738 A 9/1999 Muehle et al.
5,999,210 A 12/1999 Nemiroff et al.
6,012,980 A 1/2000 Yoshida et al.
6,028,593 A 2/2000 Rosenberg et al.
6,296,486 B1 10/2001 Cardaillac et al.
6,322,365 B1 11/2001 Shechter et al.
6,572,375 B2 6/2003 Shechter et al.
6,575,753 B2 6/2003 Rosa et al.
6,579,098 B2 6/2003 Shechter
2002/0009694 A1 1/2002 Rosa
2002/0012898 A1 1/2002 Shechter et al.
2002/0197584 A1 12/2002 Kendir et al.
2003/0136900 A1 7/2003 Shechter et al.
2003/0199324 A1 * 10/2003 Wang ..... 463/51

FOREIGN PATENT DOCUMENTS

DE 3045509 7/1982
DE 3537323 4/1987
DE 3631081 A1 3/1988
DE 39 25 640 A1 2/1991
DE 4005940 8/1991
DE 4029877 A1 3/1992
DE 42 07 933 A1 9/1993
DE 42 33 945 A1 4/1994
DE 195 19 503 A1 12/1995
EP 0 072 004 A2 2/1983
EP 0 285-586 A2 10/1988
EP 0 401 731 6/1990
EP 0467090 A1 1/1992
EP 0806621 11/1997
FR 2 726 639 A1 5/1996
GB 2141810 A 1/1985
GB 2254403 10/1992
GB 2284 253 A 5/1995
JP 49-103499 9/1974
JP 50-22497 3/1975
JP 54-40000 3/1979
JP 56-500666 5/1981
JP 59-191100 12/1984
JP 63-502211 8/1988
JP 2-101398 A 4/1990
JP 5-223500 8/1993
JP 8-299605 11/1996
RU 2 089 832 C1 9/1997
SU 1817825 A3 5/1993
WO WO 80/02741 12/1980
WO WO 87/04512 7/1987
WO WO 91/09266 6/1991
WO WO 92/08093 5/1992
WO WO 94/03770 2/1994
WO WO 94/15165 7/1994
WO WO 96/15420 5/1996
WO WO 98/49514 11/1998
WO WO 99/10700 3/1999

* cited by examiner

FIREARM LASER TRAINING SYSTEM AND METHOD FACILITATING FIREARM TRAINING WITH VARIOUS TARGETS AND VISUAL FEEDBACK OF SIMULATED PROJECTILE IMPACT LOCATIONS

CROSS-REFERENCE TO RELATED APPLICATIONS

This application is a continuation of U.S. patent application Ser. No. 09/878,786 entitled "Firearm Laser Training System and Method Facilitating Firearm Training with Various Targets and Visual Feedback of Simulated Projectile Impact Locations", and filed Jun. 11, 2001, now U.S. Pat. No. 6,616,452 which claims priority from U.S. Provisional Patent Application Ser. Nos. 60/210,595, entitled "Firearm Laser Training System and Method Facilitating Firearm Training with Various Targets" and filed Jun. 9, 2000, and 60/260,522, entitled "Firearm Laser Training System and Method Facilitating Firearm Training With Visual Feedback of Simulated Projectile Impact Locations" and filed Jan. 10, 2001. The disclosures of the above-mentioned patent applications are incorporated herein by reference in their entireties.

BACKGROUND OF THE INVENTION

1. Technical Field

The present invention pertains to firearm training systems, such as those disclosed in U.S. patent application Ser. No. 09/486,342, entitled "Network-Linked Laser Target Firearm Training System" and filed Feb. 25, 2000; Ser. No. 09/761,102, entitled "Firearm Simulation and Gaming System and Method for Operatively Interconnecting a Firearm Peripheral to a Computer System" and filed Jan. 16, 2001; Ser. No. 09/760,610, entitled "Laser Transmitter Assembly Configured For Placement Within a Firing Chamber and Method of Simulating Firearm Operation" and filed Jan. 16, 2001; Ser. No. 09/760,611, entitled "Firearm Laser Training System and Method Employing Modified Blank Cartridges for Simulating Operation of a Firearm" and filed Jan. 16, 2001; Ser. No. 09/761,170, entitled "Firearm Laser Training System and Kit Including a Target Having Sections of Varying Reflectivity for Visually Indicating Simulated Projectile Impact Locations" and filed Jan. 16, 2001; and Ser. No. 09/862,187, entitled "Firearm Laser Training System and Method Employing an Actuable Target Assembly" and filed May 21, 2001. The disclosures of the above-mentioned patent applications are incorporated herein by reference in their entireties. In particular, the present invention pertains to a firearm laser training system that accommodates various targets for facilitating a variety of firearm training activities.

2. Discussion of the Related Art

Firearms are utilized for a variety of purposes, such as hunting, sporting competition, law enforcement and military operations. The inherent danger associated with firearms necessitates training and practice in order to minimize the risk of injury. However, special facilities are required to facilitate practice of handling and shooting the firearm. These special facilities tend to provide a sufficiently sized area for firearm training and/or confine projectiles propelled from the firearm within a prescribed space, thereby preventing harm to the surrounding environment. Accordingly, firearm trainees are required to travel to the special facilities in order to participate in a training session, while the training sessions themselves may become quite expensive since each session requires new ammunition for practicing handling and shooting of the firearm.

In addition, firearm training is generally conducted by several organizations (e.g., military, law enforcement, firing ranges or clubs, etc.). Each of these organizations may have specific techniques or manners in which to conduct firearm training and/or qualify trainees. Accordingly, these organizations tend to utilize different types of targets, or may utilize a common target, but with different scoring criteria. Further, different targets may be employed by users for firearm training or qualification to simulate particular conditions or provide a specific type of training (e.g., grouping shots, hunting, clay pigeons, etc.).

The related art has attempted to overcome the above-mentioned problems by utilizing laser or light energy with firearms to simulate firearm operation and indicate simulated projectile impact locations on targets. For example, U.S. Pat. No. 4,164,081 (Berke) discloses a marksman training system including a translucent diffuser target screen adapted for producing a bright spot on the rear surface of the target screen in response to receiving a laser light beam from a laser rifle on the target screen front surface. A television camera scans the rear side of the target screen and provides a composite signal representing the position of the light spot on the target screen rear surface. The composite signal is decomposed into X and Y Cartesian component signals and a video signal by a conventional television signal processor. The X and Y signals are processed and converted to a pair of proportional analog voltage signals. A target recorder reads out the pair of analog voltage signals as a point, the location of which is comparable to the location on the target screen that was hit by the laser beam.

U.S. Pat. No. 5,281,142 (Zaenglein, Jr.) discloses a shooting simulation training device including a target projector for projecting a target image in motion across a screen, a weapon having a light projector for projecting a spot of light on the screen, a television camera and a microprocessor. An internal device lens projects the spot onto a small internal device screen that is scanned by the camera. The microprocessor receives various information to determine the location of the spot of light with respect to the target image.

U.S. Pat. No. 5,366,229 (Suzuki) discloses a shooting game machine including a projector for projecting a video image that includes a target onto a screen. A player may fire a laser gun to emit a light beam toward the target on the screen. A video camera photographs the screen and provides a picture signal to coordinate computing means for computing the X and Y coordinates of the beam point on the screen.

International Publication No. WO 92/08093 (Kunnecke et al.) discloses a small arms target practice monitoring system including a weapon, a target, a light-beam projector mounted on the weapon and sighted to point at the target and a processor. An evaluating unit is connected to the camera to determine the coordinates of the spot of light on the target. A processor is connected to the evaluating unit and receives the coordinate information. The processor further displays the spot on a target image on a display screen.

The systems described above suffer from several disadvantages. In particular, the Berke, Zaenglein, Jr. and Suzuki systems employ particular targets or target scenarios, thereby limiting the types of firearm training activities and simulated conditions provided by those systems. Further, the Berke system utilizes both front and rear target surfaces during operation. Thus, placement of the target is restricted to areas having sufficient space for exposure of those surfaces to a user and the system. The Zaenglein, Jr. and Suzuki systems employ a video projector, a video camera and associated components for operation, thereby increasing system complexity and costs. In addition, the Berke and Kunnecke et al. systems merely display impact locations to a user, thereby requiring a user to interpret the display to assess user performance during an activity. The assessment is typically limited to the information provided on the display, thereby restricting feedback of valuable training information to the user and limiting the training potential of the system.

OBJECTS AND SUMMARY OF THE INVENTION

Accordingly, it is an object of the present invention to accommodate various types of targets within a firearm laser training system to conduct varying types of training, qualification and/or entertainment activities.

It is another object of the present invention to easily calibrate a firearm laser training system prior to and during use.

Yet another object of the present invention is to employ user-specified targets within a firearm laser training system to conduct desired training procedures.

A further object of the present invention is to assess user performance within a firearm laser training system by determining scoring and/or other performance information based on detected impact locations of simulated projectiles on a target.

The aforesaid objects are achieved individually and/or in combination, and it is not intended that the present invention be construed as requiring two or more of the objects to be combined unless expressly required by the claims attached hereto.

According to the present invention, a firearm laser training system includes a target having a plurality of zones, a laser transmitter assembly that attaches to a firearm, a sensing device configured to scan the target and detect beam impact locations thereon, and a processor in communication with the sensing device. The processor displays an image of the target including detected impact locations and further evaluates user performance by providing scoring and/or other information that is based on the detected impact locations. The sensing device may be configured to determine coordinate information associated with each detected impact location and send those coordinates to the processor for further processing. Alternatively, the sensing device may be configured to send an image to the processor at selected time intervals, where the processor determines impact location coordinates from the image information received from the sensing device. The firearm laser training system of the present invention accommodates various types of targets to facilitate a variety of firearm training, qualification and/or entertainment activities. In addition, the system may be compact and portable to facilitate ease of use in a variety of different environments.

The above and still further features and advantages of the present invention will become apparent upon consideration of the following detailed description of specific embodiments thereof, particularly when taken in conjunction with the accompanying drawings wherein like reference numerals in the various figures are utilized to designate like components.

DETAILED DESCRIPTION OF THE PREFERRED EMBODIMENTS

Figure 1:
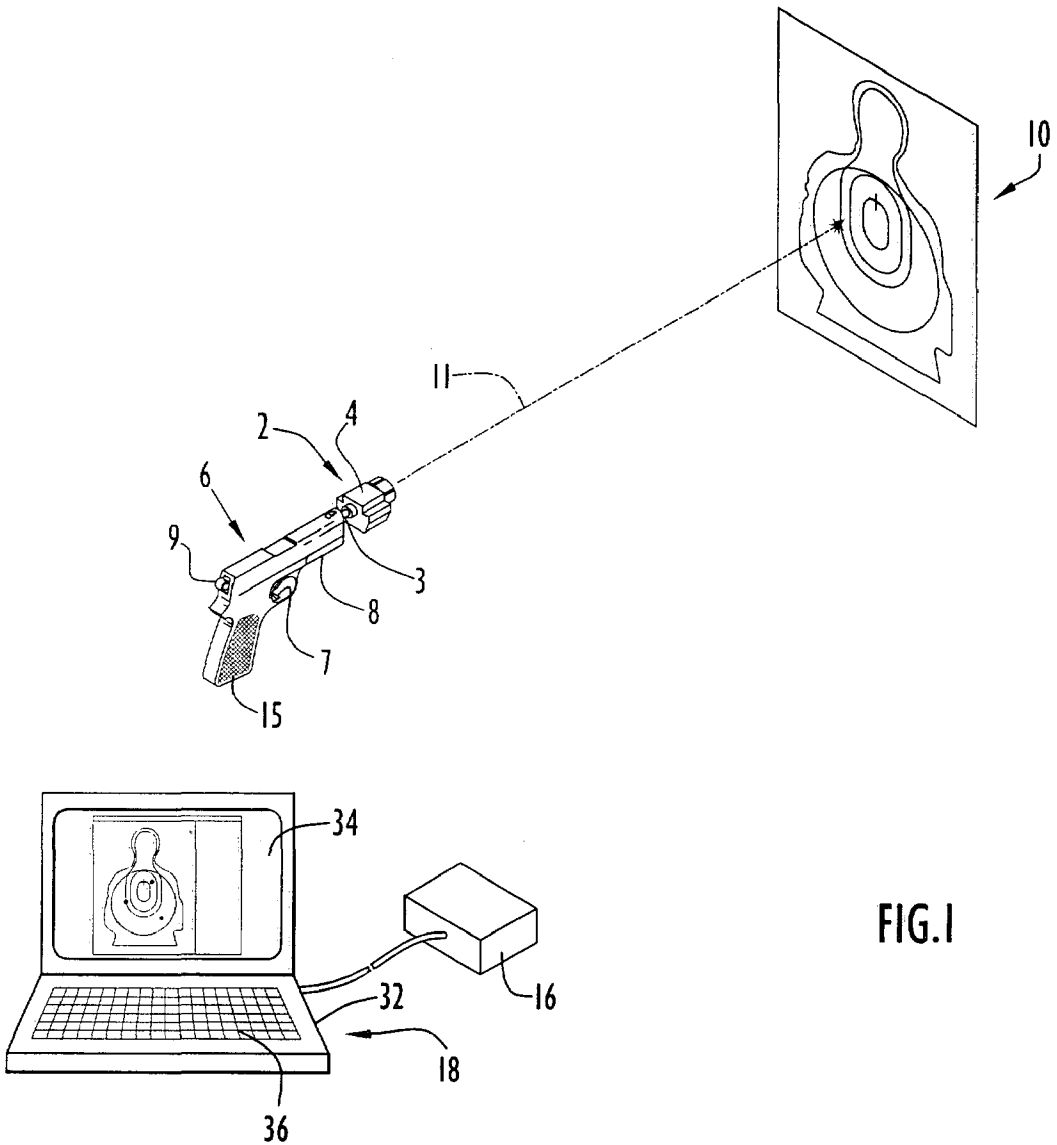
FIG. 1 is a view in perspective of a firearm laser training system having a laser beam directed from a firearm onto a target according to the present invention.

A firearm laser training system that accommodates various types of targets according to the present invention is illustrated in FIG. 1. Specifically, the firearm laser training system includes a laser transmitter assembly 2, a target 10, an image sensing device 16 and a computer system 18. The laser assembly is attached to an unloaded user firearm 6 to adapt the firearm for compatibility with the training system. By way of example only, firearm 6 is implemented by a conventional hand-gun and includes a trigger 7, a barrel 8, a hammer 9 and a grip 15. However, the firearm may be implemented by any conventional firearms (e.g., hand-gun, rifle, shotgun, etc), while the laser and firearm combination may be implemented by any of the simulated firearms disclosed in the above-mentioned patent applications. Laser assembly 2 includes a laser transmitter rod 3 and a laser transmitter module 4 that emits a beam 11 of visible laser light in response to actuation of trigger 7. Rod 3 is connected to module 4 and is configured for insertion within barrel 8 to fasten the laser assembly to the barrel as described below. A user aims unloaded firearm 6 at target 10 and actuates trigger 7 to project laser beam 11 from laser module 4 toward the target. Sensing device 16 detects the laser beam impact location on the target and provides location information to computer system 18. The computer system processes the location information and displays simulated projectile impact locations on a scaled target via a graphical user screen (FIG. 4) as described below. In addition, the computer system determines scoring and other information based upon the performance of a user.

The system may be utilized with various types of targets to facilitate firearm training and/or qualifications (e.g., certification to a particular level or to use a particular firearm). The system may additionally be utilized for entertainment purposes (e.g., in target shooting games or sporting competitions). By way of example only, target 10 is implemented by a two-dimensional target, preferably constructed of paper or other material, and attached to or suspended from a supporting structure, such as a wall. The target includes indicia forming a transitional type target having a silhouette of a person with several sections or zones (e.g., typically between five and seven) defined therein. The target sections are each typically assigned a value in order to determine a score for a user. The sections and values typically vary based on the system application and/or particular organization (e.g., military, law enforcement, firearm club, etc.) utilizing the system. Further, plural target sections (e.g., contiguous or non-contiguous) may be associated with a common value, while each section may be of any shape or size. The score is determined by accumulating the values of the target sections impacted by the laser beam during the firearm activity. The values of the target sections may further be multiplied by a scoring factor set by the system and/or the user to accommodate various scoring schemes utilized by different organizations. The computer system receives the beam impact locations from the sensing device and retrieves the section values corresponding to the impact locations as described below. Section values for each beam impact are accumulated to produce a score for a user. The target may be of any shape or size, may be constructed of any suitable materials and may include any indicia to provide any type of target for facilitating any type of training, qualification, gaming, entertainment or other activity. Moreover, the system may utilize any conventional, simulated or "dry fire" type firearms (e.g., hand-gun, rifle, shotgun, firearms powered by air/carbon dioxide, etc.), or firearms utilizing blank cartridges such as those disclosed in the above-mentioned patent applications, for projecting a laser beam to provide full realism in a safe environment.

Figure 2:
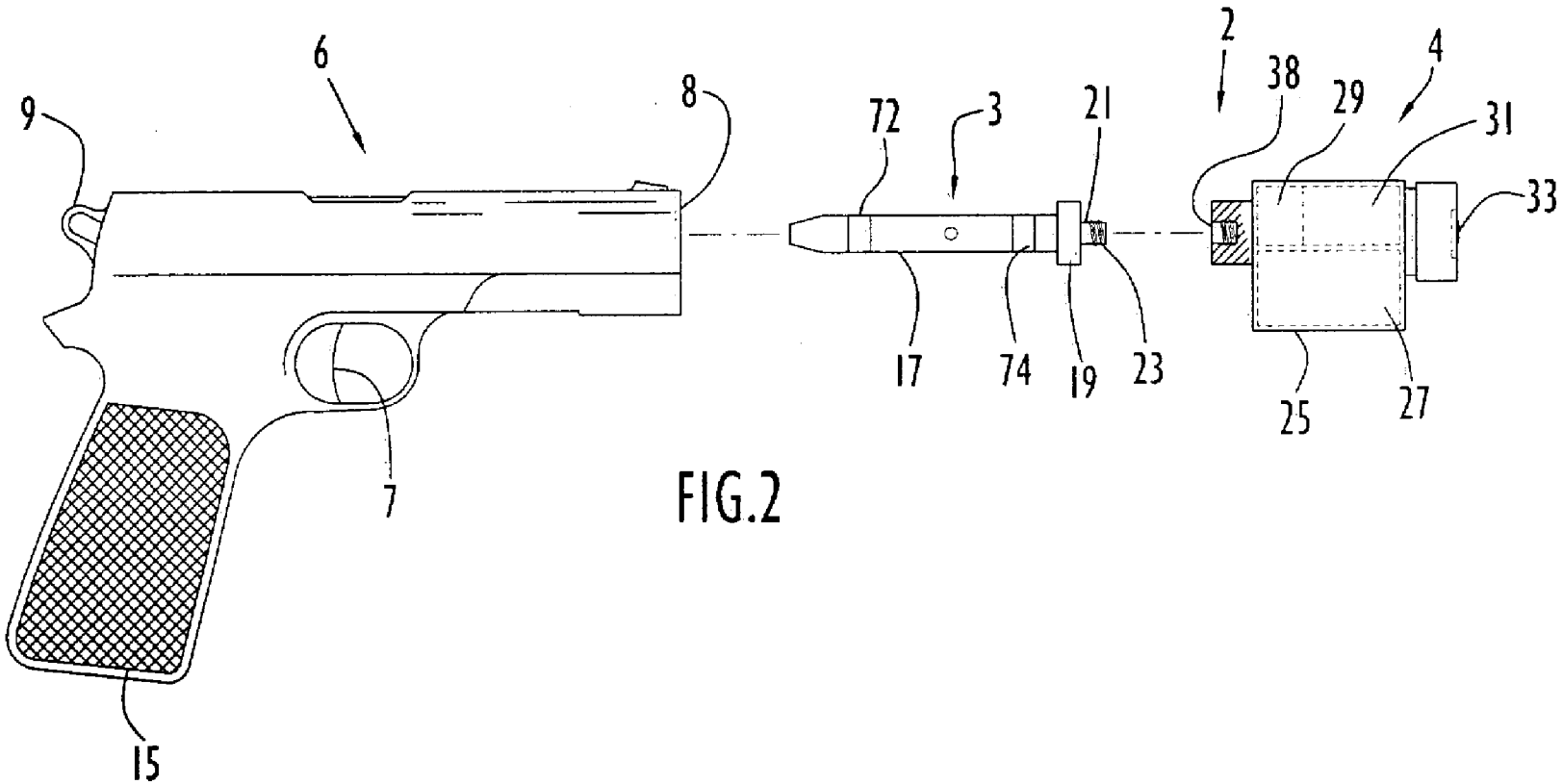
FIG. 2 is an exploded view in perspective and partial section of a laser transmitter assembly of the system of FIG. 1 fastened to a firearm barrel.

An exemplary laser transmitter assembly employed by the training system is illustrated in FIG. 2. Specifically, laser assembly 2 includes laser transmitter rod 3 and laser transmitter module 4. Rod 3 includes a generally cylindrical barrel member 17 and a stop 19 disposed at the barrel member distal end. The barrel member is elongated with a tapered proximal end and has transverse cross-sectional dimensions that are slightly less than the internal cross-sectional dimensions of barrel 8 to enable the barrel member to be inserted within the barrel. However, the barrel member may be of any shape or size to accommodate firearms of various calibers. Adjustable rings 72, 74 are disposed about the barrel member toward its proximal and distal ends, respectively. The dimensions of each ring are adjustable to enable barrel member 17 to snugly fit within and frictionally engage barrel 8 in a secure manner. Stop 19 is in the form of a substantially circular disk having a diameter slightly greater than the cross-sectional dimensions of barrel 8 to permit insertion of rod sections proximal of the stop into the barrel. The stop may alternatively be of any shape or size capable of limiting insertion of the rod into the barrel. Barrel member 17 is connected to the approximate center of stop 19, while a post 21 is attached to and extends distally for a slight distance from an approximate center of a stop distal surface. Post 21 is substantially cylindrical and has transverse cross-sectional dimensions similar to those of barrel member 17, but may be of any shape or size. The post includes external threads 23 for facilitating engagement with laser module 4 as described below.

Laser module 4 includes a housing 25 having an internally threaded opening 38 defined in an upper portion of a housing rear wall for receiving post 21 and attaching the laser module to rod 3. The housing and opening may be of any shape or size, while the opening may be defined in the housing at any suitable location. The laser module components are disposed within the housing and include a power source 27, typically in the form of batteries, a mechanical wave sensor 29 and an optics package 31 having a laser (not shown) and a lens 33. These components may be arranged within the housing in any suitable fashion. The optics package emits laser beam 11 through lens 33 toward target 10 or other intended target in response to detection of trigger actuation by mechanical wave sensor 29. Specifically, when trigger 7 is actuated, hammer 9 impacts the firearm and generates a mechanical wave which travels distally along barrel 8 toward rod 3. As used herein, the term "mechanical wave" or "shock wave" refers to an impulse traveling through the firearm barrel. Mechanical wave sensor 29 within the laser module senses the mechanical wave from the hammer impact and generates a trigger signal. The mechanical wave sensor may include a piezoelectric element, an accelerometer or a solid state sensor, such as a strain gauge. Optics package 31 within the laser module generates and projects laser beam 11 from firearm 6 in response to the trigger signal. The optics package laser is generally enabled for a predetermined time interval sufficient for the sensing device to detect the beam. The beam may be coded, modulated or pulsed in any desired fashion. Alternatively, the laser module may include an acoustic sensor to sense actuation of the trigger and enable the optics package. The laser module is similar in function to the laser devices disclosed in the aforementioned patent applications. The laser assembly may be constructed of any suitable materials and may be fastened to firearm 6 at any suitable location by any conventional or other fastening technique.

Referring back to FIG. 1, computer system 18 is coupled to and receives and processes information from sensing device 16 to provide various feedback to a user. The computer system is typically implemented by a conventional IBM-compatible laptop or other type of personal computer (e.g., notebook, desk top, mini-tower, Apple Macintosh, palm pilot, etc.) preferably equipped with display or monitor 34, a base 32 (i.e., including the processor, memories, and internal or external communication devices or modems) and a keyboard 36 (e.g., including a mouse or other input device). Computer system 18 includes software to enable the computer system to communicate with sensing device 16 and provide feedback to the user. The computer system may utilize any of the major platforms (e.g., Linux, Macintosh, Unix, OS2, etc.), but preferably includes a Windows environment (e.g., Windows 95, 98, NT, or 2000). Further, the computer system includes components (e.g. processor, disk storage or hard drive, etc.) having sufficient processing and storage capabilities to effectively execute the system software. By way of example only, computer system 18 includes a pentium or compatible processor and at least sixteen megabytes of RAM.

Computer system 18 is connected to sensing device 16 via a cable and preferably utilizes an RS-232 type interface. The sensing device may be mounted on a tripod and positioned at a suitable location from the target. However, any type of mounting or other structure may be utilized to support the sensing device. The sensing device is typically implemented by a camera employing charge-coupled devices (CCD), but may be implemented by any type of light sensing grid array or element matrix. The sensing device detects the location of beam impact on the target (e.g., by capturing an image of the target and detecting the location of the beam impact from the captured image) and includes a signal processor and associated circuitry to provide impact location information in the form of X and Y coordinates to computer system 18, or provide other data to the computer system to enable determination of those coordinates. By way of example only, the sensing device may be similar to the image sensing devices disclosed in U.S. Pat. No. 5,181,015 (Marshall et al.), U.S. Pat. No. 5,400,095 (Minich et al.), U.S. Pat. No. 5,489,923 (Marshall et al.), U.S. Pat. No. 5,502,459 (Marshall et al.), U.S. Pat. No. 5,504,501 (Hauck et al.), U.S. Pat. No. 5,515,079 (Hauck), U.S. Pat. No. 5,594,468 (Marshall et al.) and U.S. Pat. No. 5,933,132 (Marshall et al.), the disclosures of which are incorporated herein by reference in their entireties. However, the computer system may utilize any type of input device providing impact location or other information (e.g., a mouse to simulate firearm operation). The computer system instructs the sensing device to perform a calibration to correlate the target with a scaled target space utilized by the sensing device as described below. The calibration essentially defines the target space to the sensing device to enable the sensing device and/or computer system to correlate beam impact locations on the target with X and Y coordinates within the scaled target space (e.g., correlate the target field or plane with the sensing device field or plane). The resulting coordinates or location information is transmitted to the computer system for translation to coordinates within the computer system's scaled target spaces to facilitate scoring and display of beam impact locations as described below. A printer (not shown) may further be connected to the computer system to print reports containing user feedback information (e.g., score, hit/miss information, etc.). The computer system and/or sensing device may determine X and Y coordinate information corresponding to beam impact locations from any type of information.

The system may be utilized with various types of targets. Target characteristics are contained in several files that are stored by computer system 18. In particular, a desired target may be photographed and/or scanned prior to system utilization to produce several target files and target information. Alternatively, images of user generated targets may be captured via sensing device 16 and optionally manipulated to form a target image, while computer system 18 or other computer system (e.g., via training system or conventional software) may be utilized to produce the target files and target information for use by the system. A target file includes a parameter file, a display image file, a scoring image file and a print image file. The parameter file includes information to enable the computer system to control system operation. By way of example only, the parameter file includes the filenames of the display, scoring and print image files, a scoring factor and cursor information (e.g., grouping criteria, such as circular shot group size). The display and print image files include an image of the target scaled to particular sections of the monitor and report containing that image, respectively. Indicia, preferably in the form of substantially circular icons, are overlaid on these images to indicate beam impact locations, and typically include an identifier to indicate the particular shot (e.g., the position number of the shot within a shot sequence). The dimensions of the indicia may be adjusted to simulate different ammunition or firearm calibers entered by a user. The scoring image file includes a scaled scoring image of the target having scoring sections or zones shaded with different colors. Any variation of colors may be utilized, and the colors are each associated with corresponding information associated with that zone. The zone information typically includes scoring values, but may include any other types of activity information (e.g., target number, desirable/undesirable hit location, priority of hit location, friend/foe, etc.). When impact location information is received from the sensing device, computer system 18 translates that information to coordinates within the scoring image. The color associated with the image location identified by the translated coordinates indicates a corresponding zone and/or scoring value. In effect, the colored scoring image functions as a look-up table to provide a zone value based on coordinates within the scoring image pertaining to a particular beam impact location. The scoring value of an impact location may be multiplied by a scoring factor within the parameter file to provide scores compatible with various organizations and/or scoring schemes. Thus, the scoring of the system may be adjusted by modifying the scoring factor within the parameter file and/or the scoring zones on the scoring image within the scoring image file. Alternatively, when other activity information is associated with the zones, the scoring image file may indicate occurrence of various events (e.g., hit/miss of target locations, target sections impacted based on priority, hit friend or foe, etc.) in substantially the same manner described above.

In addition, the target files typically include a second display file containing a scaled image of the target. The dimensions of this image are substantially greater than those of the image contained in the initial display image file, and the second display file is preferably utilized to display a target having plural independent target sites. The target files along with scaling and other information (e.g., target range information input by user) are stored on computer system 18 for use during system operation. An initial calibration is performed to correlate the target with the sensing device and computer system. This calibration may be performed manually or automatically as described below. Thus, the system may readily accommodate any type of target without interchanging system components. Moreover, target files may be downloaded from a network, such as the Internet, and loaded into the computer system to enable the system to access and be utilized with additional targets.

Sensing device 16 may alternatively be implemented by an image capture and sensing device that may include a removable filter and operate in a learning mode and a training mode. The learning mode is utilized without the filter to capture and produce an image of a desired target. The sensing device initially captures a target image and modifies the image to correct for geometrical offsets, optics and lighting variances, and performs other image enhancement techniques. The enhanced image is provided to the computer system for display, and corresponds with increased accuracy to the target. Scaling and other information is also provided to or by the computer system to facilitate translations of received beam impact location coordinates and scoring as described above, thereby minimizing calibration.

When the system is utilized, the filter (e.g., an approximate 650 nanometer bandpass filter is placed) is placed over the sensing device to filter incoming light signals and to enable the device to detect laser beam impact locations in response to user actuation of the firearm. The sensing device provides X and Y coordinates or other location information to the computer system to display the impact location and determine scoring and other information as described above. The sensing device may be adjusted or calibrated at specific time intervals (e.g., twenty minutes, fifty minutes, etc.) or in response to particular events (e.g., initiation of a session, termination of a session, etc.). Specifically, the computer system may perform a calibration or may command the sensing device to perform the calibration with or without the filter. An image is captured and verified for consistency with the previously captured image. When the images are inconsistent, the new image is enhanced and utilized as described above.

Figure 3:
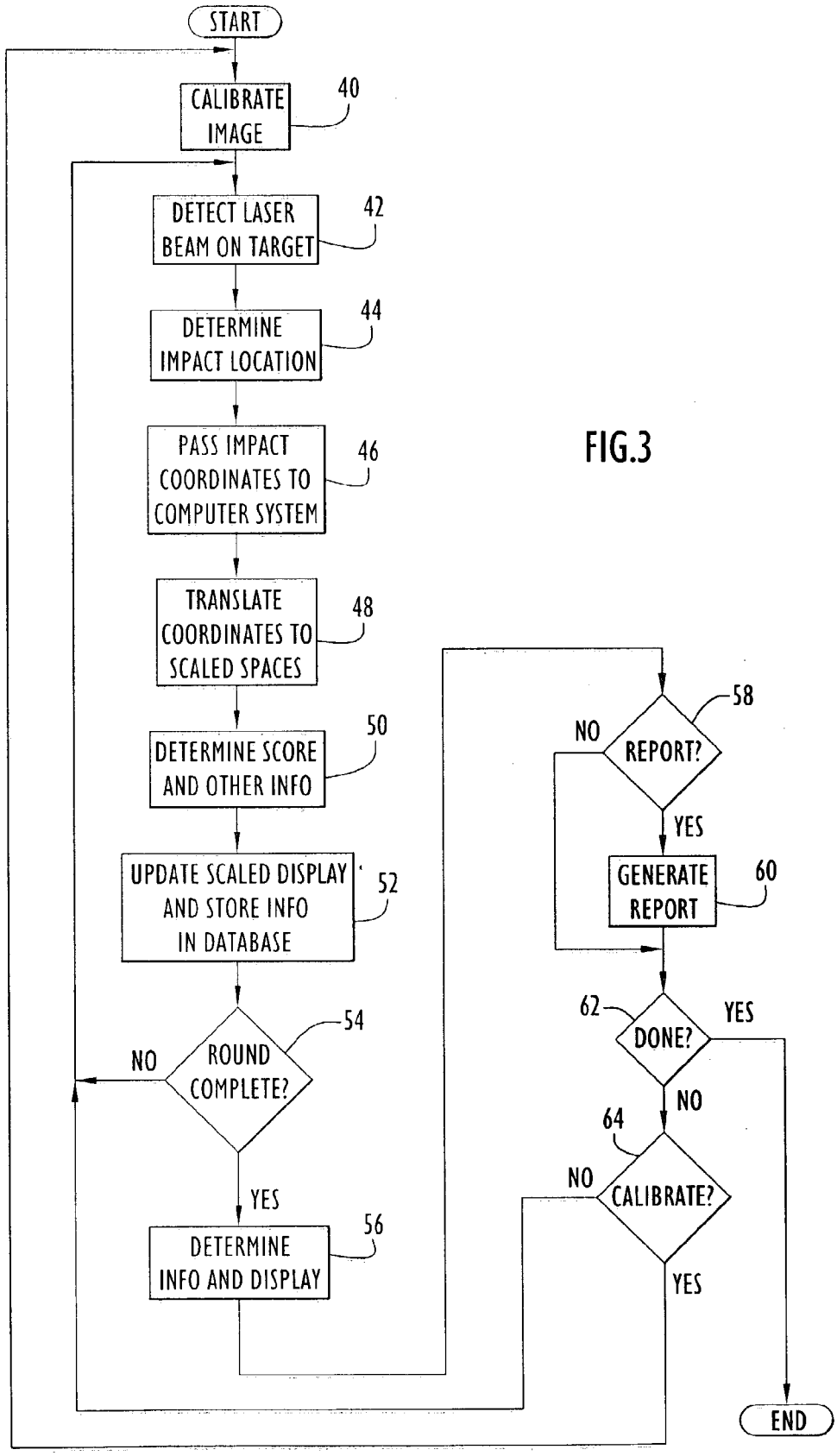
FIG. 3 is a procedural flow chart illustrating the manner in which the system of FIG. 1 processes and displays laser beam impact locations according to the present invention.
Figure 4:
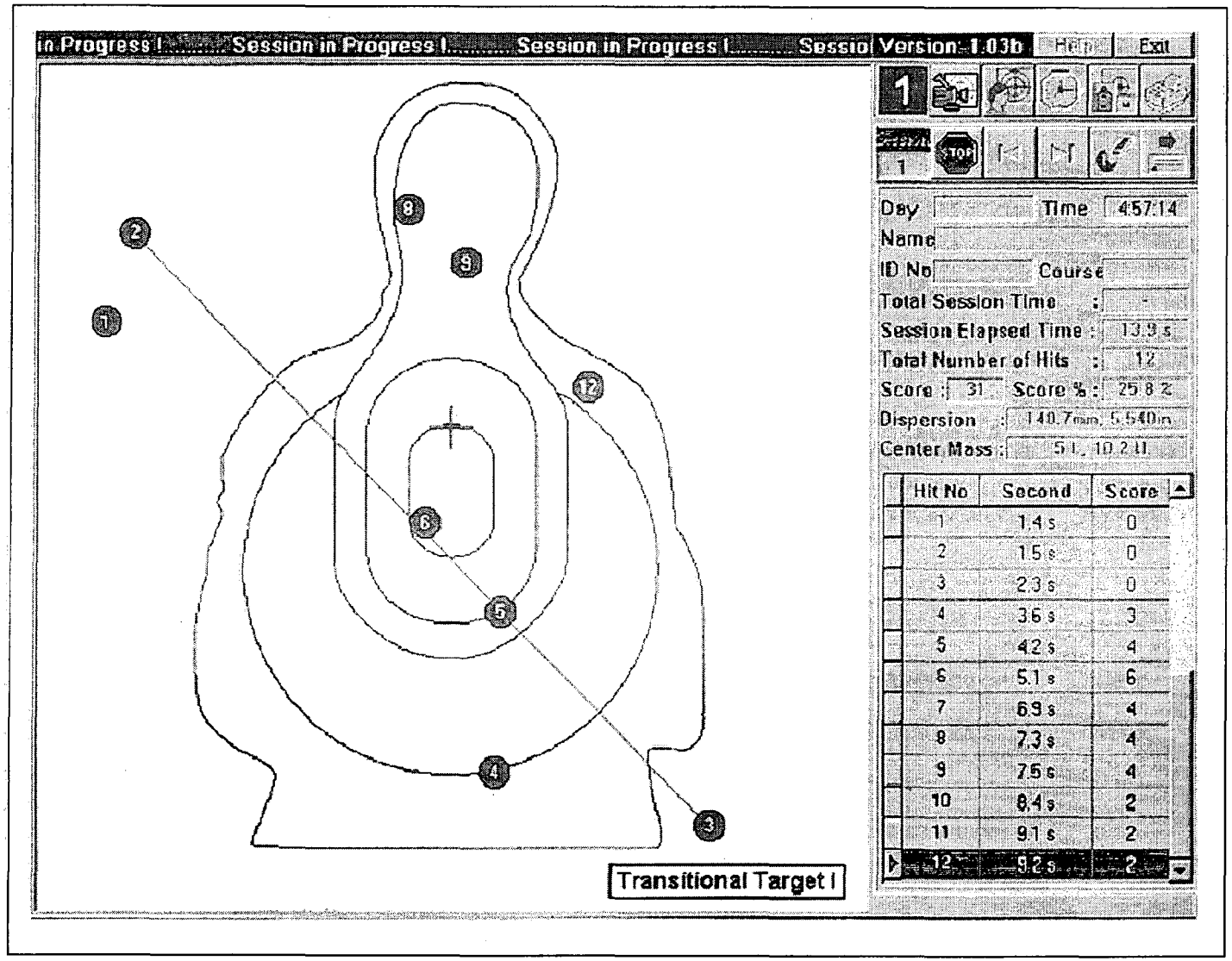
FIG. 4 is a schematic illustration of an exemplary graphical user screen displayed by the system of FIG. 1 for firearm activities.

Computer system 18 includes software to control system operation and provide a graphical user interface for displaying user performance. The manner in which the computer system monitors beam impact locations and provides information to a user is illustrated in FIGS. 3–4. Initially, computer system 18 (FIG. 1) directs the sensing device to perform a calibration at step 40. The sensing device basically defines a target area within a grid array (e.g., 8192 by 8192 pixels) in response to the user projecting the laser beam at one or more specified target locations. For example, the sensing device may prompt the user via computer system 18 to successively project the laser beam at the target corners. The beam is detected by the sensing device, while the impact locations define the target area. Alternatively, any other technique may be utilized to identify and reference the target area (e.g., projecting a single laser beam at the target center, providing indicia on the target at known coordinate locations, etc.). The target area is mapped to the grid array to facilitate providing beam impact location coordinates within the array to computer system 18 as described below. The calibration is typically performed at system initialization, but may be initiated by a user via computer system 18.

Once the system is calibrated, a user may commence projecting the laser beam from the firearm toward the target. Sensing device 16 detects the laser beam impact location on the target at step 42, and determines the X and Y coordinates within the device grid array corresponding to the beam impact location at step 44. The impact location coordinates are subsequently transmitted to computer system 18 for processing at step 46. The computer system includes several target files having target information and scaled images as described above. Since the scaling of the scoring and display images and sensing device array are predetermined, the computer system translates the received grid array coordinates into the respective scoring and display image coordinate spaces at step 48. Basically, the sensing device grid array and scoring and display images each utilize a particular quantity of pixels for a given measurement unit (e.g., millimeter, centimeter, etc.). The ratios of these pixel quantities between the grid array and each of the scoring and display images are determined and applied to the received coordinates to produce translated coordinates within each of the respective scoring and display image coordinate spaces. The received and/or translated coordinates may be further processed and/or manipulated to determine fine calibration adjustments, ballistics or other factors related to specific applications.

The translated coordinates for the scoring image are utilized to determine the score for the beam impact at step 50. Specifically, the translated coordinates identify a particular location within the scoring image. When zones are associated with scoring information, various sections of the scoring image are color coded to indicate a scoring value associated with that section as described above. The color of the location within the scoring image identified by the translated coordinates is ascertained to indicate the scoring value for the beam impact. The scoring factor within the parameter file is applied to (e.g., multiplied by) the scoring value to determine a score for the beam impact. The score and other impact information is determined and stored in a database or other storage structure, while a computer system display showing the target is updated to illustrate the beam impact location and other information (e.g., natural dispersion, mean point of impact, offset of impact from center of target, such as quantity of units above, below, left or right of target, impact score, cumulative score, etc.) at step 52. The display image is displayed on the computer monitor and includes the beam impact location as identified by indicia that are overlaid with the display image and placed in an area encompassing the translated display image coordinates. An exemplary graphical user screen indicating the target, beam impact locations, impact time, score and other information is illustrated in FIG. 4.

If a round or session of firearm activity is not complete as determined at step 54, the user continues actuation of the firearm and the system detects beam impact locations and determines information as described above. However, when a round or session is determined to be complete at step 54, the computer system retrieves information from the database and determines information pertaining to the round at step 56. The computer system may further determine grouping circles. These are generally utilized on shooting ranges where projectile impacts through a target must all be within a circle of a particular diameter (e.g., four centimeters). The computer system may analyze the beam impact information and provide groupings and other information on the display that is typically obtained during activities performed on firing ranges (e.g., dispersion, etc.). The grouping circle and beam impact location indicia are typically overlaid with the display image and placed in areas encompassing the appropriate coordinates of the display image space in substantially the same manner described above.

When a report is desired as determined at step 58, the computer system retrieves the appropriate information from the database and generates a report for printing at step 60. The report includes the print image, while beam impact location coordinates are retrieved from the database and translated to the print image coordinate space. The translation is accomplished utilizing ratios of pixel quantities for a given measurement unit between the sensing device grid array and the print image in substantially the same manner described above. The beam impact locations are identified by indicia that are overlaid with the print image and placed in an area encompassing the translated print image coordinates as described above for the display. The report further includes various information pertaining to user performance (e.g., score, dispersion, mean point of impact, offset from center, etc.). When another round is desired, and a calibration is requested at step 64, the computer system commands the sensing device to perform the calibration at step 40 and the above process of system operation is repeated. Similarly, the above process of system operation is repeated from step 42 when another round is desired without performing a calibration. System operation terminates upon completion of the training or qualification activity as determined at step 62.

The system may additionally provide a tracing feature to assist in verifying calibration and providing information to a user with respect to firearm movement during aiming and actuation. In particular, the trace feature is enabled in response to the laser transmitter assembly operating in a "constant on" mode. When the sensing device detects the laser beam continuously for approximately one and one-half seconds, the computer system displays a flashing block on the graphical user screen. The block follows movement of the firearm or laser beam projected on the target. Basically, the computer system polls the sensing device for coordinates of the laser beam impact location at frequent time intervals. The coordinates are translated by the computer system as described above and the position of the block is adjusted on the display in accordance with the translated coordinates. As the firearm or laser beam alters position, the block is similarly adjusted on the display to visually indicate movement of the firearm.

Operation of the system is described with reference to FIG. 1. Initially, a target is selected and placed on a supporting structure, while corresponding target files containing target information are produced and stored in the computer system. Laser transmitter rod 3 is connected to laser module 4 and inserted into barrel 8 of firearm 6 as described above. The laser module is actuated in response to depression of firearm trigger 7. Any of the lasers or firearms disclosed in the above-mentioned patent applications may be utilized (e.g., systems employing dry fire weapons, air/carbon dioxide powered weapons and/or weapons utilizing blank cartridges, etc.). The computer system is commanded to commence a firearm activity, and initially instructs the sensing device to perform a calibration as described above. The user aims the firearm at the target and depresses the trigger to project a laser beam at specified locations on the target to enable the sensing device to perform the calibration. Once the sensing device is calibrated, and in response to firearm actuation by a user, the sensing device detects beam impact locations on the target and provides impact location information in the form of X and Y coordinates to the computer system as described above. The computer system translates the received coordinates into the respective scoring and display image spaces and further determines a value corresponding to the impacted target section and other information for storage in a database as described above. The impact location and other information are displayed on a graphical user screen (FIG. 4) as described above. When a round is complete, the computer system retrieves the stored information and determines information pertaining to the round for display on the graphical user screen. Moreover, a report may be printed providing information relating to user performance as described above. In addition, the system may provide indicia on the display to indicate and trace firearm movement as described above. Alternatively, the sensing device may capture the target image and provide target information to the computer system to minimize calibrations as described above.

Figure 5:
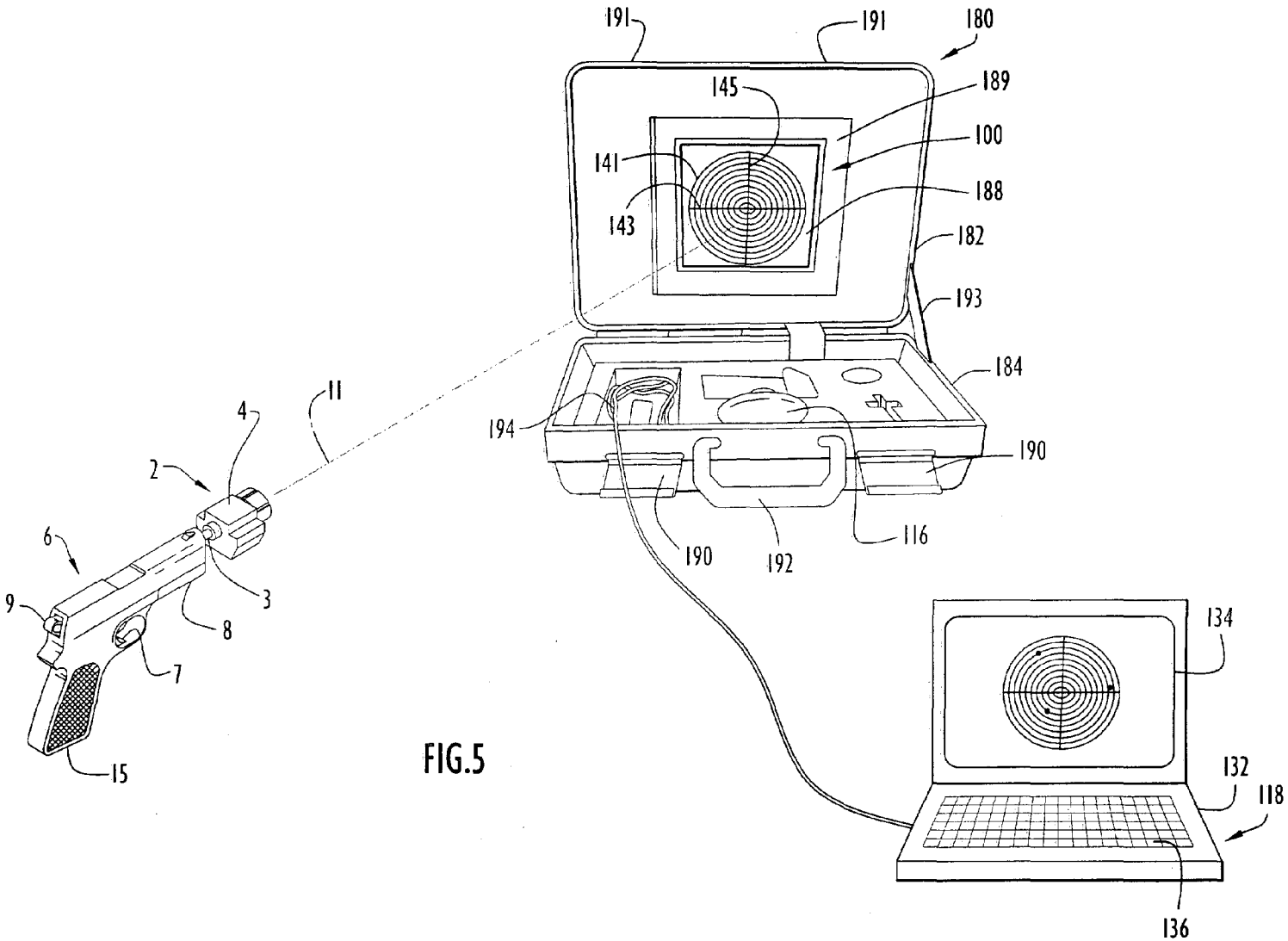
FIG. 5 is a view in perspective of a firearm laser training system having a laser beam directed from a firearm onto a target according to an alternative embodiment of the present invention.

An alternative embodiment of the present invention is illustrated in FIG. 5. Specifically, the firearm laser training system includes laser transmitter assembly 2, a target 100 and an image sensing device 116. These and other system components are preferably stored within a system case 180 as described below. The laser transmitter assembly is substantially similar to and operates in a substantially similar manner as the laser transmitter assembly described above. In order to facilitate system operation, the image sensing device is connected to user computer system 118 having training system software installed thereon, while the laser assembly is attached to unloaded user firearm 6 in substantially the same manner described above to adapt the firearm for compatibility with the training system. When a user aims firearm 6 at target 100 and actuates trigger 7, a laser beam 11 is projected from laser module 4 toward the target. Sensing device 116 captures images of the target and provides target image information to computer system 118 as described below. The computer system processes the target image information and displays simulated projectile impact locations on a scaled target via a graphical user screen (FIG. 8) as described below. In addition, the computer system determines scoring and other information pertaining to the performance of a user.

The alternative system may be utilized with various types of targets to facilitate firearm training. By way of example only, target 100 is illustrated as a bulls eye type target, preferably constructed of paper or other material and having a plurality of substantially concentric circles 141 and substantially diametric horizontal and vertical quadrant dividing lines 143, 145. The target is suspended from system case 180 as described below. The target includes several sections or zones defined therein (e.g., between the concentric circles, etc.). The target sections are each typically assigned a value in order to determine a score for a user. However, the sections may be associated with other activity information to facilitate determination of various impact characteristics as described above. The sections and values typically vary based on the system application. Further, plural target sections (e.g., contiguous or non-contiguous) may be associated with a common value, while each section may be of any shape or size. The score is determined by accumulating the values of the target sections impacted by the laser beam during the firearm activity. The computer system receives target image information from the sensing device and determines the beam impact locations to retrieve the section values corresponding to those impact locations as described below. Section values for each beam impact are accumulated to produce a score for a user. The target may be of any shape or size, may be constructed of any suitable materials and may include any indicia to provide any type of target for facilitating any type of training. Moreover, the system may be utilized with any of the conventional, simulated or "dry fire" type firearms described above.

System case 180 includes upper and lower members 182, 184 pivotally connected to each other by hinges or other pivoting mechanisms. The lower member includes an open top portion and generally rectangular front, rear and side walls that collectively define the lower member interior or storage area. Similarly, upper member 184 includes an open bottom portion and generally rectangular front, rear and side walls that collectively define the upper member interior or storage area. The hinges or pivoting mechanisms are typically attached to the upper and lower member rear walls, while the lower member front wall or surface includes fasteners 190 that selectively engage corresponding fastening members 191 disposed on the upper member front wall or surface to secure the case in a closed state. Further, a handle 192 is disposed on the lower member front wall or surface between fasteners 190 to enable transport of the system case, thereby providing a portable system that may be utilized at virtually any suitable location. A support member 193 is connected between the upper and lower members to enable the case to maintain an open state with the upper member positioned at any desired angle relative to the lower member. This enables target 100 to be visible to a user and reduces glare from ambient light within the surrounding environment as described below.

The system case typically houses system components to enable the system to be available as a self-contained, portable unit. Specifically, lower member 184 includes insulation material, such as foam, configured to form several compartments each for receiving a corresponding system component. The compartments typically contain sensing device 116 and corresponding sensing device stands (not shown), a cable 194 for connecting the sensing device to computer system 118 and laser transmitter assembly 2 and a corresponding tool (e.g., an Allen wrench; not shown) to adjust the laser transmitter assembly for attachment to firearm 6. The lower member may further house additional targets, system software and/or documentation, a mock firearm (e.g., compressed air firearm) or any other additional system components or accessories.

Upper member 182 supports target 100 and includes a substantially rectangular flap 189 having one side edge attached to the upper member interior surface to serve as a pivot point for the flap. The remaining flap edges are removably fastened to the upper member interior surface via hook and loop fasteners (e.g., velcro) or other conventional fastening devices to receive, secure and support target 100 within the upper member. The flap has dimensions sufficient to engage the target perimeter and includes an open central portion to enable viewing of the target by a system user. A substantially transparent diffuser 188 may be disposed between the target and flap to diffuse the emitted beam and enlarge the beam on the target. The diffuser further reduces glare from ambient light within the surrounding environment. In addition, the upper member is typically positioned at a particular angle relative to the lower member (e.g., preferably between the approximate range of eighty to ninety degrees) to similarly reduce glare from ambient light. This enhances detection of the beam impact location by the sensing device and computer system.

The system case is generally available with sensing device 116 and corresponding sensing device stands, cable 194, laser transmitter assembly 2 and corresponding tool, a plurality of interchangeable targets (e.g., bull's-eye, silhouette, and deer or other animal optionally designating a particular target area or "kill" shot) and system software and documentation. However, the case may include any system components or accessories and be arranged in any desired fashion. A user basically positions the case at a suitable location and opens the case to place a desired target and the diffuser within the flap. The laser transmitter is removed from the case and attached to the user firearm, while the software is installed on user computer system 118 (e.g., if the software is not currently resident on the computer system). The sensing device is positioned relative to the target and connected to the computer system via the cable. Once the software is executed, the system may simulate firearm operation as described below. Thus, the present invention provides a portable, self-contained unit compatible with virtually any firearm and facilitating firearm training at various locations.

Computer system 118 is substantially similar to the computer system described above and preferably includes a monitor 134, base 132 (e.g., including the processor, memories, internal or external communication devices or modems, sound devices, etc.) and keyboard 136 (e.g., including a mouse or other input device). The computer system is coupled to sensing device 116 and includes software to enable the computer system to communicate with and receive and process information from sensing device 116 to provide various feedback to a user. The computer system may utilize any of the major platforms (e.g., Linux, Macintosh, Unix, OS2, etc.), but preferably includes a Windows environment (e.g., Windows 95, 98, NT, or 2000). Further, the computer system includes components (e.g. processor, disk storage or hard drive, etc.) having sufficient processing (e.g., preferably at least a 300 MHZ processor) and storage capabilities (e.g., preferably at least 32 MB of RAM) to effectively execute the system software.

Sensing device 116 is preferably connected to a Universal Serial Bus (USB) port of computer system 118 via cable 194. The sensing device is typically implemented by a sensory image type camera employing charge-coupled devices (CCD) or CMOS. However, the sensing device may be implemented by any type of light or image sensing device and may be connected to computer system 118 via any type of port (e.g., serial, parallel, USB, etc.). The sensing device typically has a speed or rate of thirty frames per second and repeatedly captures an image of the target and provides target image information to the computer system at that rate. In other words, an image of the target is captured by the sensing device and provided to the computer system within a frame approximately thirty times per second. Alternatively, the sensing device may detect the location of beam impact on the target and include a signal processor and associated circuitry to provide impact location information in the form of X and Y coordinates to computer system 118 for processing in substantially the same manner described above. The computer system may further utilize any type of input device providing impact location or other information (e.g., a mouse to simulate firearm operation).

The image characteristics of the sensing device enable the device to capture images of the target including any changes to the target (e.g., beam impacts) occurring between successive frame transmissions. Thus, the sensing device facilitates detection of beam impact from laser transmitters having a pulse duration less than the frame rate (e.g., pulse durations as low as approximately one millisecond). The computer system may measure the pulse duration of a laser transmitter based on the quantity of succeeding frames containing a laser pulse. The system is typically configured for laser pulses having a duration of approximately six milliseconds, and provides messages to a user when lasers having other pulse durations are utilized. The sensing device performs an internal initialization sequence where the frame rate is initially low and increases to the operational rate (e.g., approximately thirty frames per second). Computer system 118 measures the sensing device frame rate (e.g., determines the quantity of frames received per second) and delays system operation until the sensing device attains the operational rate. Calibrations are further performed by the system to align the sensing device and target, to define the target within the captured target images and to adjust for ambient light conditions as described below. A printer (not shown) may further be connected to the computer system to print reports containing user feedback information (e.g., score, hit/miss information, etc.), while individual firearm training sessions may be stored.

The system may be utilized with various types of targets with target characteristics contained in several files that are stored on computer system 118. In particular, a desired target may be photographed and/or scanned prior to system utilization to produce several target files and target information as described above. Alternatively, a user may capture images of user generated targets via the sensing device and utilize computer system 118 or other computer system (e.g., via training system or conventional software) to produce the target files and target information for use by the system as described above. The target files include a parameter file, a display image file, a scoring image file, a print image file and a second display file, each substantially similar to the corresponding target file described above. The files are utilized by the system in substantially the same manner described above to provide scoring or other information, displays and printed reports. The produced files along with scaling and other information (e.g., produced based on user information, such as range) are stored on computer system 118 for use during system operation. An initial calibration is performed to correlate the target with the sensing device and computer system. Thus, the system may readily accommodate any type of target without interchanging system components. Moreover, target images may be downloaded from a network, such as the Internet, and printed for use with the system as described above. The downloaded target image may be utilized to generate target files as described above or the target files may similarly be available on the network and downloaded into the computer system. The network basically provides access to additional targets for use with the system.

Figure 6:
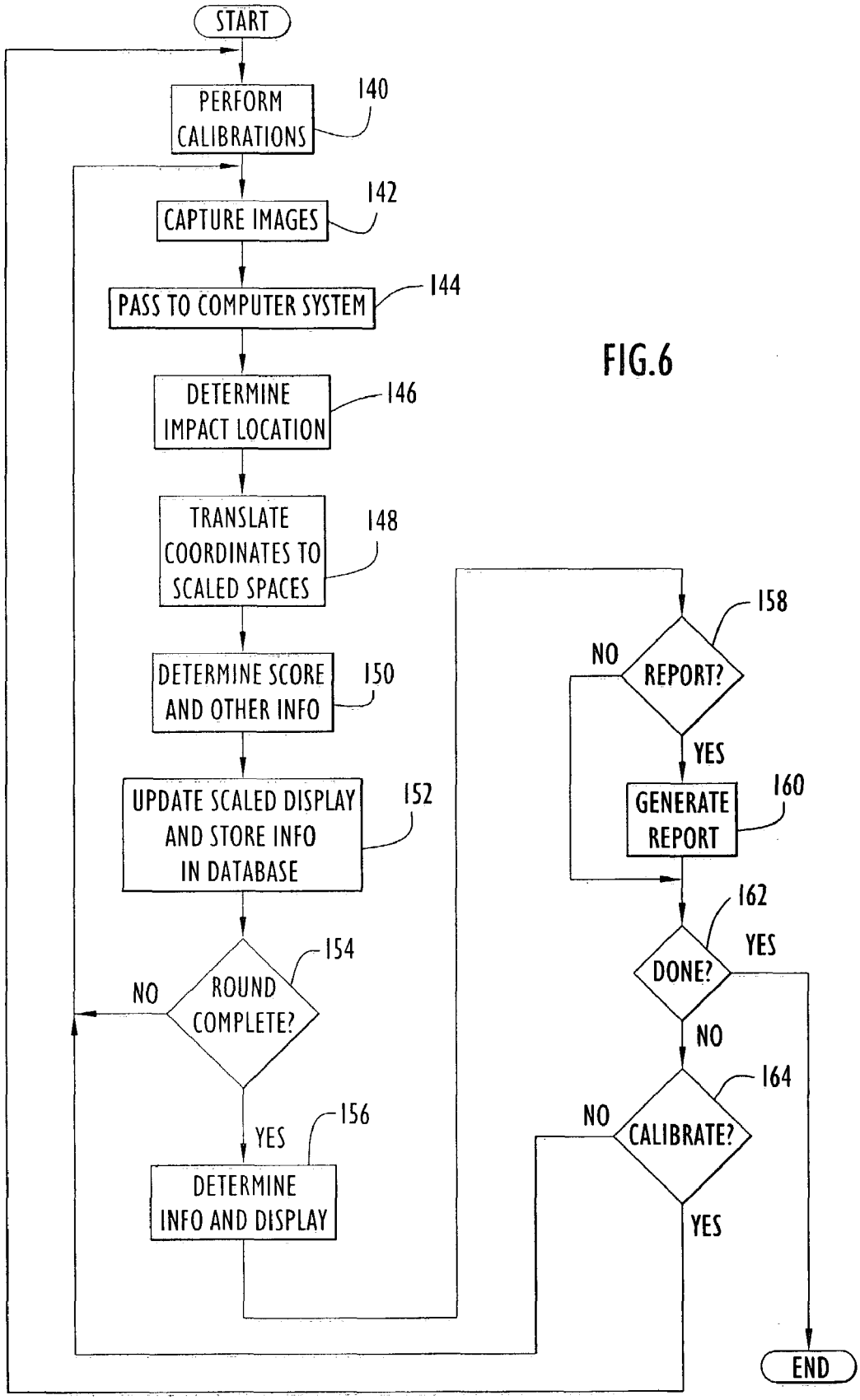
FIG. 6 is a procedural flow chart illustrating the manner in which the system of FIG. 5 processes and displays laser beam impact locations according to the present invention.
Figure 7:
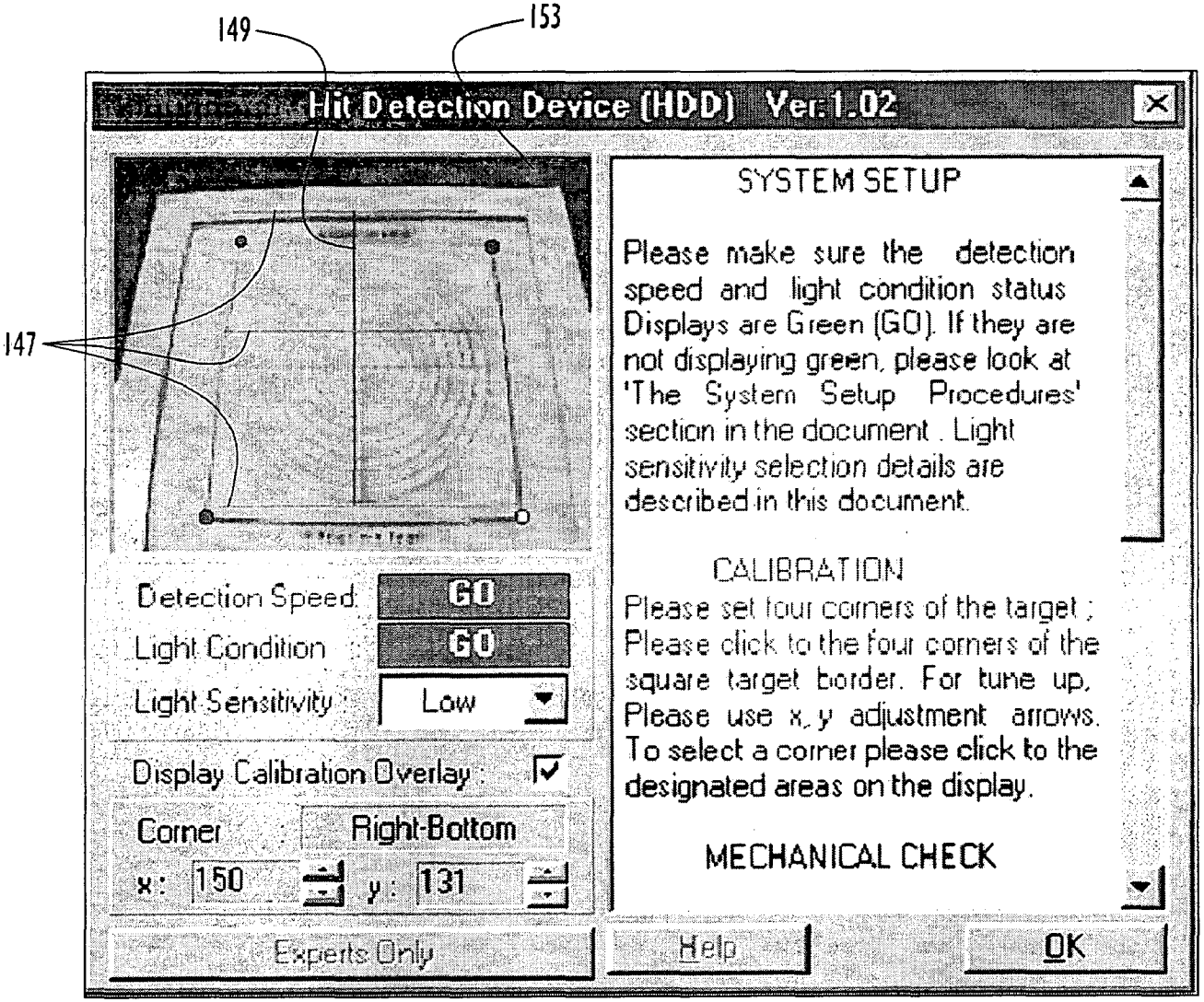
FIGS. 7–8 are schematic illustrations of exemplary graphical user screens displayed by the system of FIG. 5 during system operation.
Figure 8:
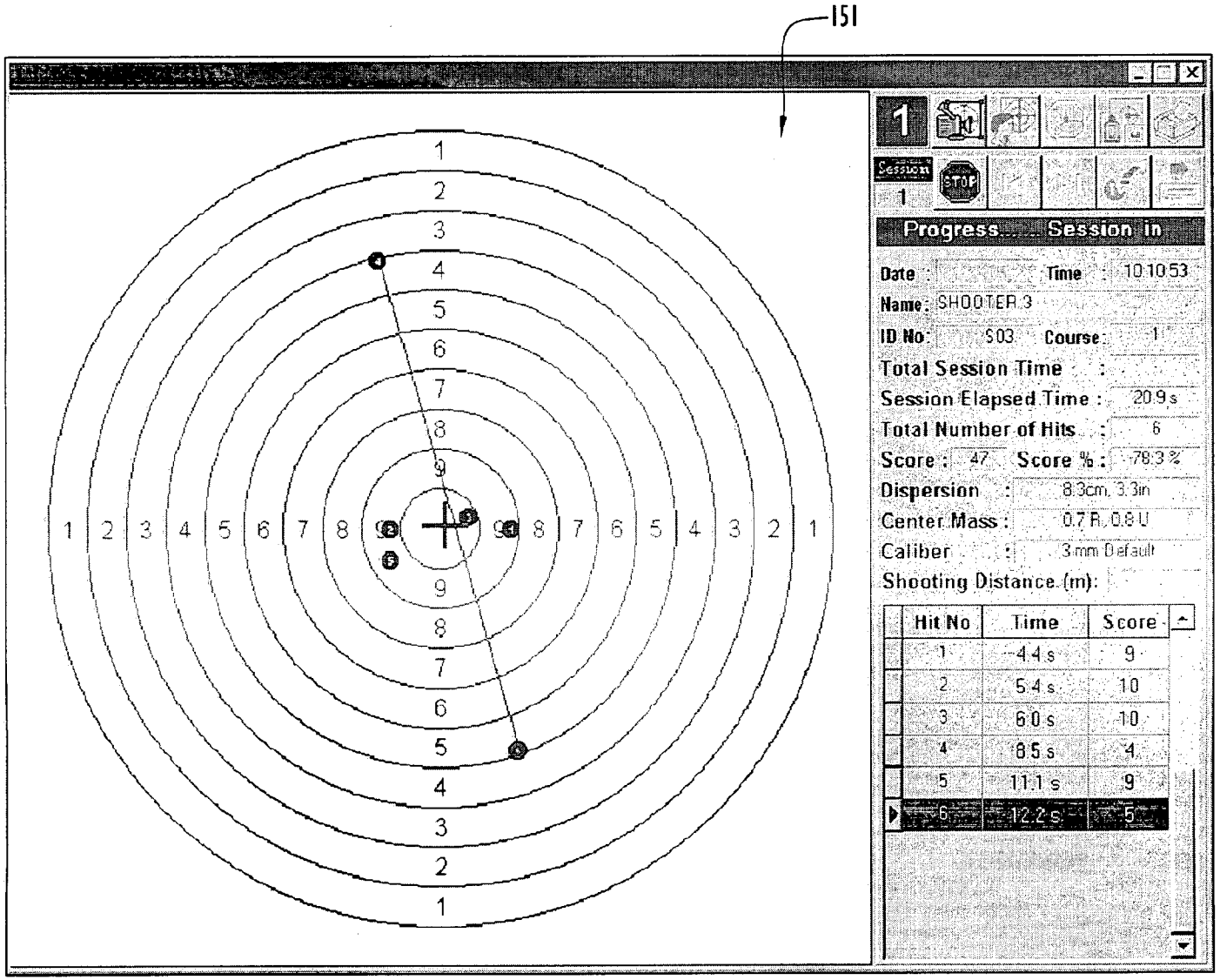

Computer system 118 includes software to control system operation and provide a graphical user interface for displaying user performance. The manner in which the computer system monitors beam impact locations and provides information to a user is illustrated in FIGS. 6–8. Initially, computer system 118 (FIG. 5) performs calibrations at step 140. Basically, the computer system performs a mechanical calibration and a system calibration. The mechanical calibration generally facilitates alignment of the sensing device with the target and computer system, while the system calibration enables determination of parameters for system operation. In particular, the computer system preferably displays a calibration graphical user screen (FIG. 7) including a window 153 displaying the captured target images to initiate the calibrations. The computer system basically updates the captured target image displayed in the window with successive captured target images as they are received from the sensing device. The calibration screen further displays a series of substantially parallel horizontal lines 147 and a substantially central vertical line 149 overlaid with the received captured target images within window 153, coordinates of selected locations within window 153, and screen input mechanisms (e.g., arrows, buttons, etc.) to enable a user to selectively adjust the displayed coordinates. Basically, sensing device 116 faces, but is typically positioned below, the target. Accordingly, the sensing device captures images of the target having an upward viewing angle. This angle causes the sensing device to produce generally trapezoidal images of the target, where the target lower section has greater transverse dimensions than those of the target upper section within the produced images. The computer system compensates for the device viewing angle and requests the user to indicate, preferably via a mouse or other input device, the corners of the target displayed by the captured target images within window 153 of the calibration screen. The coordinates for a corner designated by a user are displayed on the screen, where the user may selectively adjust the coordinates. This process is repeated for each corner to define for computer system 118 the target within the captured target images. The horizontal and vertical lines 147, 149 are adjusted in accordance with the entered information to indicate the system perspective of the target. The calibration may be repeated until horizontal lines 147 are substantially coincident the corresponding target horizontal edges and target horizontal center line and vertical line 149 is substantially coincident the target vertical center line, thereby indicating alignment of the target with the system. Alternatively, the target or diffuser may include indicia (e.g., colored stickers in the form of dots or other shapes) indicating the target corners to enable the computer system to automatically define the target based on identifying the indicia within the captured target images received from sensing device 116. The computer system basically correlates the captured target images with the target viewed by the user to determine the beam impact locations. In other words, the computer system compensates for the viewing angle of the sensing device with respect to that of the user to determine appropriate beam impact locations from the target image information.

The system sensitivity to the emitted beam and ambient light conditions may be selectively adjusted by the user or may be determined by computer system 118 based on measured conditions. Basically, the computer system determines a laser luminance or density value of the beam impact on the target from the target image information received from the sensing device. Specifically, each captured target image includes a plurality of pixels each associated with red (R), green (G) and blue (B) values to indicate the color and luminance of that pixel. The red, green and blue values for each pixel are multiplied by a respective weighting factor and summed to produce a pixel density. In other words, the pixel density may be expressed as follows:

$$\text{Pixel Density}=(R\times\text{Weight1})+(G\times\text{Weight2})+(B\times\text{Weight3})$$

where Weight1, Weight2 and Weight3 are weighting values that may be selected in any fashion to enable the system to identify beam impact locations within the captured target images. The respective weights may have the same or different values and may be any types of values (e.g., integer, real, etc.). The beam impact location is considered to occur within a group of pixels within a captured image where each group member has a density value exceeding a threshold. Typically, the group of pixels containing or representing the beam impact form an area or shape. The pixel at the center of the area or shape formed by the pixel group is considered by the system to contain, or represent the location of, a beam impact. Since target images are being repeatedly captured and transmitted to the computer system at the sensing device operational rate (e.g., approximately thirty frames per second), certain captured target images may not contain any beam impact detections. Accordingly, the threshold basically controls the system sensitivity to the emitted beam in relation to the ambient light, and enables the system to determine the presence of a beam impact within a captured target image. The threshold is generally increased to reduce the quantity of false hits detected by the system during system operation. The computer system determines maximum and average density values from the captured target image pixel values and adjusts the threshold accordingly. The pixel density values of each captured target image may additionally be accumulated and/or averaged to provide an indication of the ambient light condition or luminance.

During calibration, the computer system requests the user to actuate firearm 6 and project a beam onto the target. Alternatively, the calibration may utilize data collected during system operation as described below. The computer system receives captured target images from the sensing device and automatically determines the detection speed of the sensing device, the ambient light condition and the laser density threshold as described above. These parameters may be displayed in the form of color displays indicating that the parameter values are within acceptable tolerances or the parameter values may be displayed in terms of a percentage (e.g., a percentage of the maximum acceptable values for the parameters). However, the values may be displayed in any desired fashion. Further, the calibration screen may display horizontal and vertical positional offsets that may be utilized by the computer system to determine beam impact locations. The determined threshold value as well as any desired positional offsets (e.g., horizontal and or vertical) may be selectively adjusted by the user via the mouse or other input device. For example, the threshold value may be set by the user to a high, medium or low setting via a user screen pull down list or other input devices to achieve a desired system sensitivity with respect to the amount of ambient light present during system operation.

The computer system may further automatically determine the threshold in the manner described above in response to detecting changes in light conditions during system operation. In particular, the computer system determines density values for the pixels of each captured target image during system operation. The values are accumulated and/or averaged to provide a lighting value representing the ambient light condition. If the lighting value achieves levels outside an acceptable range, computer system 118 interrupts system operation to determine a new threshold value. The computer system typically waits for the light conditions to produce acceptable lighting values prior to determining a new threshold. The settings determined by the calibrations and/or selected by the user may be stored by the computer system for later utilization by the system, thereby obviating the need to re-calibrate the system when conditions remain in substantially the same state (e.g., lighting condition, position of sensing device, etc.). The mechanical and system calibrations are typically performed at system initialization, but may be initiated by a user via computer system 118.

Once the calibrations are completed, a user may commence projecting the laser beam from the firearm toward the target. Sensing device 116 captures target images at step 142, and transmits the captured target images to computer system 118 for processing at step 144. The computer system processes the captured target images to determine a beam impact location at step 146. Specifically, each captured target image received from the sensing device includes a plurality of pixels each associated with red (R), green (G) and blue (B) values to indicate the color and luminance of that pixel as described above. The red, green and blue values for each pixel are multiplied by a respective weighting factor and summed to produce a pixel density as described above.

A beam impact is considered to occur within a pixel group of a captured target image where each group member has a density value exceeding a threshold. The pixel group forms an area or shape where the center pixel of that area or shape is considered by the system to contain, or represent the location of, the beam impact. If the density value of each captured image pixel is less than the threshold, the captured target image is not considered to include a beam impact. When the computer system identifies a pixel containing a beam impact, the coordinates (e.g., X and Y coordinates) of that pixel within the captured target image are determined by the computer system. These coordinates represent the location of a beam impact within the captured target image and are subsequently processed to compensate for the sensing device viewing angle. In other words, the captured target image coordinates are converted from a generally trapezoidal target image produced by the sensing device viewing angle to coordinates within a generally rectangular target image representing the view of the user and the scoring and display files.

The computer system includes several target files having target information and scaled images as described above. Since the scaling of the scoring and display images are predetermined, the computer system translates the resulting processed or converted coordinates into the respective scoring and display image coordinate spaces at step 148. Basically, the scoring and display images each utilize a particular quantity of pixels for a given measurement unit (e.g., millimeter, centimeter, etc.), while the quantity of pixels for the target is determined from the trapezoidal target image. The ratios of the pixel quantities between the target and each of the scoring and display images are determined and applied to the processed or converted coordinates to produce translated coordinates within each of the respective scoring and display image coordinate spaces.

In addition, the computer system may determine the pulse width of the laser beam as described above and provide messages in response to a user utilizing a laser having an unsuitable pulse width with respect to the system configuration. The system preferably is configured for laser transmitters emitting a pulse having a duration of six milliseconds, and can be utilized with laser pulses having a duration as low as one millisecond. However, the system may be utilized and/or configured for operation with laser transmitters having any desired pulse width.

The translated coordinates for the scoring image are utilized to determine the score or other activity information for the beam impact at step 150. Specifically, the translated coordinates identify a particular location within the scoring image. Various sections of the scoring image are color coded to indicate a value or other activity information associated with that section as described above. The color of the location within the scoring image identified by the translated coordinates is ascertained to indicate the value or other activity information for the beam impact. The scoring factor within the parameter file is applied to (e.g., multiplied by) the score value to determine a score for the beam impact. The score and other impact information is determined and stored in a database or other storage structure, while a computer system display showing the target is updated to illustrate the beam impact location and other information (e.g., natural dispersion, center of mass, caliber, impact score, cumulative score, score percentage, elapsed time, time between shots, etc.) at step 152. The display image is displayed, while the beam impact location is identified by indicia that are overlaid with the display image and placed in an area encompassing the translated display image coordinates. The indicia may be scaled to reflect the caliber of the firearm. In addition, the computer system may provide audio (e.g., resembling firearm shots and/or hits) to indicate beam impact. An exemplary graphical user screen indicating the target, beam impact locations, impact time, score and other information is illustrated in FIG. 8. The system is preferably configured to detect, process and display up to approximately four shots per second, but may be adjusted to accommodate any desired shooting rate.

If a round or session of firearm activity is not complete as determined at step 154, the user continues actuation of the firearm and the system detects beam impact locations and determines information as described above. However, when a round or session is determined to be complete at step 154, the computer system retrieves information from the database and determines information pertaining to the round at step 156. The computer system may further determine grouping circles. These are generally utilized on shooting ranges where projectile impacts through a target must all be within a circle of a particular diameter (e.g., four centimeters). The computer system may analyze the beam impact information and provide groupings and other information on the display that is typically obtained during activities performed on firing ranges (e.g., dispersion, etc.). The grouping circle and beam impact location indicia are typically overlaid with the display image and placed in areas encompassing the appropriate coordinates of the display image space in substantially the same manner described above.

When a report is desired as determined at step 158, the computer system retrieves the appropriate information from the database and generates a report for printing at step 160. The report includes the print image, while beam impact location coordinates are retrieved from the database and translated to the print image coordinate space. The translation is accomplished utilizing ratios of pixel quantities for a given measurement unit between the target and the print image in substantially the same manner described above. The beam impact locations are identified by indicia that are overlaid with the print image and placed in an area encompassing the translated print image coordinates as described above for the display. The report further includes various information pertaining to user performance (e.g., score, dispersion, center of mass, caliber, impact score, cumulative score, score percentage, elapsed time, time between shots, etc.). When another round is desired, and a calibration is requested at step 164, the computer system performs the calibrations at step 140 and the above process of system operation is repeated. Similarly, the above process of system operation is repeated from step 142 when another round is desired without performing a calibration. System operation terminates upon completion of the training or qualification activity as determined at step 162.

The system may additionally provide a trace feature similar to the trace feature described above. In particular, the trace feature is enabled in response to the laser transmitter assembly operating in a "constant on" mode. When the computer system detects the laser beam continuously for a predetermined time interval (e.g., the laser is detected within a predetermined quantity of consecutive frames of target image information as described above), preferably greater than approximately one-hundred milliseconds, the computer system displays a flashing block on the graphical user screen (FIG. 8). The block follows movement of the firearm or laser beam projected on the target. Basically, the computer system determines coordinates of laser beam impact locations from target image information received from the sensing device and translates those coordinates to display image coordinates as described above. The position of the block is adjusted on the display in accordance with the translated coordinates. As the firearm or laser beam alters position, the block is similarly adjusted on the display to visually indicate movement of the firearm. The system preferably displays the previous ten beam impact locations to enable a user to view the movement. However, any quantity of previous locations may be displayed. In addition, the size of target 100 (FIG. 5) may be scaled to simulate firearm training at various ranges. The particular range may be entered into computer system 118, while the target may be scaled to a particular size to reflect conditions at a prescribed range. The computer system may adjust for range during calibration and operates as described above with a user positioned at a corresponding scaled distance from the target. The laser transmitter emits a beam (e.g., the laser beam has a peak power output of approximately one milliwatt) that may be detected by the system at a range of up to approximately thirty feet. However, laser transmitters having greater power may be utilized for extended ranges.

Operation of the system is described with reference to FIG. 5. Initially, system case 180 is positioned at a suitable location by the user. The case is opened and a target is selected and placed along with diffuser 188 in flap 189 of upper member 182 as described above. System software and/or target files are installed on computer system 118 as described above (e.g., if the software is not currently resident on the computer system or a new target is being utilized) and sensing device 116 is connected to the computer system via cable 194. Laser transmitter rod 3 is connected to laser module 4 and inserted into barrel 8 of firearm 6 as described above. The laser module is actuated in response to depression of firearm trigger 7. The computer system is commanded to commence a firearm activity, and initially performs calibrations subsequent initialization of sensing device 116 as described above. Once the calibrations are complete, the firearm may be actuated by a user, while the sensing device captures images of the target and provides target image information to the computer system as described above. The computer system determines the coordinates of beam impact locations within the target from the received captured target images as described above and translates those coordinates into the respective scoring and display image spaces. The computer system further determines a score value corresponding to the impacted target section and other information for storage in a database as described above. The impact location and other information are displayed on a graphical user screen (FIG. 8) as described above. When a round is complete, the computer system retrieves the stored information and determines information pertaining to the round for display on the graphical user screen. Moreover, a report may be printed providing information relating to user performance as described above. In addition, the system may provide indicia on the display to indicate and trace firearm movement as described above.

It will be appreciated that the embodiments described above and illustrated in the drawings represent only a few of the many ways of implementing a firearm laser training system and method facilitating firearm training with various targets and visual feedback of simulated projectile impact locations.

The systems may include any quantity or type of target of any shape or size, constructed of any suitable materials and placed in any desired location. The computer systems may be implemented by any conventional or other computer or processing system. The components of the systems may be connected by any communications devices (e.g., cables, wireless, network, etc.) in any desired fashion, and may utilize any type of conventional or other interface scheme or protocol. The computer systems may be in communication with other training systems via any type of communications medium (e.g., direct line, telephone line/modem, network, etc.) to facilitate group training or competitions. The systems may be configured for any types of training, qualification, competition, gaming and/or entertainment applications. The printers may be implemented by any conventional or other type of printer.

The firearm laser training systems may be utilized with any type of firearm (e.g., hand-gun, rifle, shotgun, machine gun, etc.), while the laser module may be fastened to the firearm at any suitable locations via any conventional or other fastening techniques (e.g., frictional engagement with the barrel, brackets attaching the device to the firearm, etc.). Further, the systems may include a dummy firearm projecting a laser beam, or replaceable firearm components (e.g., a barrel) having a laser device disposed therein for firearm training. The replaceable components (e.g., barrel) may further enable the laser module to be operative with a firearm utilizing any type of blank cartridges. The laser assembly may include the laser module and rod or any other fastening device. The laser module may emit any type of laser beam. The laser module housing may be of any shape or size, and may be constructed of any suitable materials. The opening may be defined in the module housing at any suitable locations to receive the rod. Alternatively, the housing and rod may include any conventional or other fastening devices (e.g., integrally formed, threaded attachment, hook and fastener, frictional engagement with the opening, etc.) to attach the module to the rod. The optics package may include any suitable lens for projecting the beam. The laser beam may be enabled for any desired duration sufficient to enable the sensing device to detect the beam. The laser module may be fastened to a firearm or other similar structure (e.g., a dummy, toy or simulated firearm) at any suitable locations (e.g., external or internal of a barrel) and be actuated by a trigger or any other device (e.g., power switch, firing pin, relay, etc.). Moreover, the laser module may be configured in the form of ammunition for insertion into a firearm firing or similar chamber and project a laser beam in response to trigger actuation. Alternatively, the laser module may be configured for direct insertion into the barrel without the need for the rod. The laser module may include any type of sensor or detector (e.g., acoustic sensor, piezoelectric element, accelerometer, solid state sensors, strain gauge, etc.) to detect mechanical or acoustical waves or other conditions signifying trigger actuation. The laser module components may be arranged within the housing in any fashion, while the module power source may be implemented by any type of batteries. Alternatively, the module may include an adapter for receiving power from a common wall outlet jack or other power source. The laser beam may be visible or invisible (e.g., infrared), may be of any color or power level, may have a pulse of any desired duration and may be modulated in any fashion (e.g., at any desired frequency or unmodulated) or encoded in any manner to provide any desired information, while the transmitter may project the beam continuously or include a "constant on" mode. The system may be utilized with transmitters and detectors emitting any type of energy (e.g., light, infrared, etc.).

The laser transmitter rod may be of any shape or size, and may be constructed of any suitable materials. The rod may include dimensions to accommodate any firearm caliber. The rings may be of any shape, size or quantity and may be constructed of any suitable materials. The rings may be disposed at any locations along the rod and may be implemented by any devices having adjustable dimensions. The stop may be of any shape or size, may be disposed at any suitable locations along the rod and may be constructed of any suitable materials. The post may be of any shape or size, may be disposed at any suitable locations on the rod, and may be constructed of any suitable materials. The post or rod may include any conventional or other fastening devices to attach the laser module to the rod.

The targets may be implemented by any type of target having any desired configuration and indicia forming any desired target site. The targets may be of any shape or size, and may be constructed of any suitable materials. The targets may include any conventional or other fastening devices to attach to any supporting structure. Similarly, the supporting structure may include any conventional or other fastening devices to secure a target to that structure. Alternatively, any type of adhesive may be utilized to secure a target to the structure. The support structure may be implemented by any structure suitable to support or suspend a target. The targets may include any quantity of sections or zones of any shape or size and associated with any desired values. The targets may include any quantity of individual targets or target sites. The systems may utilize any type of coding, color or other scheme to associate values with target sections (e.g., table look-up, target location identifiers as keys into a database or other storage structure, etc.). Further, the sections or zones may be identified by any type of codes, such as alphanumeric characters, numerals, etc., that indicate a score value or any other information. The score values may be set to any desired values.

The target characteristics and images may be contained in any quantity of any types of files. The target images may be scaled in any desired fashion. The coordinate translations may be accomplished via any conventional or other techniques, and may be performed by the sensing devices and/or computer systems. The target files may contain any information pertaining to the target (e.g., filenames, images, scaling information, indicia size, etc.). The target files may be produced by the computer systems or other processing system via any conventional or other software and placed on the computer systems for operation. Alternatively, the target files may reside on another processing system accessible to the computer systems via any conventional or other communications medium (e.g., network, modem/telephone line, etc.), or be available on any type of storage medium.

The system case may be of any size or shape and may be constructed of any suitable materials. The case may be placed at any desired location and include any quantity of any system components and/or accessories. The upper and lower members may be of any shape or size and may be constructed of any suitable materials. These members may include any quantity of any types of conventional or other fastening, pivoting and support devices disposed at any suitable locations. Further, the case may include any quantity of any types of handles and/or other transporting devices (e.g., wheels, casters, etc.) disposed at any suitable locations to facilitate transport of the case. The upper and lower members may store any quantity of any system components or accessories, and may include any type of insulation material (e.g., foam). The upper and lower members may include any quantity of compartments of any shape or size and arranged in any fashion to store the system components and/or accessories. The system components and/or accessories may be disposed in any quantity and/or combination in the case in any desired arrangement.

The upper and lower members may be positioned at any desired angle relative to each other during system operation. The components of the systems may be utilized as described above within or external of a case. The sensing device of the alternative system may be utilized with any quantity or types of stands, while the laser transmitter assembly may utilize any type of tool to facilitate adjustments. The cable may be implemented by any conventional or other cable to connect the sensing device to the computer system. The flap may be of any shape or size, may be constructed of any suitable materials and may be disposed at any suitable locations within the case. The diffuser may be of any shape or size, may be constructed of any suitable materials, may have any degree of transparency and may be disposed at any suitable location with respect to the target and laser transmitter assembly. The system may alternatively utilize the target without the diffuser.

The sensing devices may be implemented by any conventional or other sensing device (e.g., camera, CCD, matrix or array of light sensing elements, etc.) suitable for detecting the laser beam and/or capturing a target image. The filter may be implemented by any conventional or other filter having filtering properties for any particular frequency or range of frequencies. The sensing devices may employ any type of light sensing elements, and may utilize a grid or array of any suitable dimension. The sensing devices may be of any shape or size, and may be constructed of any suitable materials. The sensing devices may be supported by any mounting device (e.g., a tripod, a mounting post, etc.) and positioned at any suitable locations providing access to the targets. The calibrations may utilize any quantity of locations to define the target area, and may map the area to any sized array. The calibration locations may be any suitable locations within or outside the target confines. Alternatively, the sensing devices may be positioned at any suitable locations within or external of a case and at any desired viewing angle relative to a target. The sensing devices may be coupled to any port of the computer systems via any conventional or other device (e.g., cable, wireless, etc.). The sensing devices may provide color or black and white (e.g., gray scale) images to the computer systems and have any desired frame rate. Alternatively, the sensing devices may include processing circuitry to detect beam impact locations and provide coordinates of those locations to the computer systems. The sensing devices may be configured to detect any energy medium having any modulation, pulse or frequency. Similarly, the laser may be implemented by a transmitter emitting any suitable energy wave. The sensing devices may detect the laser beam continuously for any desired interval to initiate a tracing mode. The sensing devices may transmit any type of information to the computer system to indicate beam impact locations, while the computer systems may process any type of information (e.g., X and Y coordinates, image information, etc.) from the sensing devices to display and provide feedback information to the user.

It is to be understood that the software for the computer systems may be implemented in any desired computer language and could be developed by one of ordinary skill in the computer arts based on the functional descriptions contained in the specification and flow charts illustrated in the drawings. The computer systems may alternatively be implemented by any type of hardware and/or other processing circuitry. The various functions of the computer systems may be distributed in any manner among any quantity of software modules, processing systems and/or circuitry (e.g., including those within the sensing devices). The software and/or algorithms described above and illustrated in the flow charts may be modified in any manner that accomplishes the functions described herein. The databases may be implemented by any conventional or other database or storage structure (e.g., file, data structure, etc.).

The display screens and reports may be arranged in any fashion and contain any type of information. The various parameter or other values may be displayed in the report and/or on the screens in any manner (e.g., charts, bars, etc.) and in any desired form (e.g., actual values, percentages, etc.), while any of the values displayed on the screens may be adjusted by the user via any desired input mechanisms. The calibration screen may include any quantity of any types of indicia of any shape, color or size to facilitate alignment of the sensing device with the target and computer system. Alternatively, the computer system image may be adjusted for alignment with the sensing device and target. The target may be defined within the captured target image in any desired manner via any suitable input mechanisms. The target may be defined at any suitable locations within the captured target image or window, while the selected locations may be indicated by any quantity of any types of indicia of any shape, color or size. Alternatively, the target definition may be accomplished automatically by positioning any quantity of indicia of any color, shape or size on the target and/or diffuser at any suitable locations to define the target for the computer system.

The density value may be determined with any weights having any desired value or types of values (e.g., integer, real, etc.). The weights and pixel component values may be utilized in any desired combination to produce a pixel density. Alternatively, any quantity of pixel values within any quantity of images may be manipulated in any desired fashion (e.g., accumulated, averaged, multiplied by each other or weight values, etc.) to determine the presence and location of a beam impact within an image. Further, any quantity of density and/or pixel values within any quantity of images may be manipulated in any desired fashion (e.g., accumulated, averaged, multiplied by each other or weight values, etc.) to determine the threshold and light conditions. The threshold may be determined periodically or in response to any desired light or other conditions (e.g., light conditions are outside any desired range or have any desired change in value, etc.), and may be set by the computer system and/or user to any desired value. The systems may alternatively utilize gray scale or any type of color images (e.g., pixels having gray scale, RGB or other values) and manipulate any quantity of pixel values within any quantity of images in any desired fashion to determine the threshold, light conditions and presence and location of a beam impact.

The indicia indicating beam impact locations and other information may be of any quantity, shape, size or color and may include any type of information. The indicia may be placed at any locations and be incorporated into or overlaid with the target images. The systems may produce any desired type of display or report having any desired information. The computer systems may determine scores or other activity information based on any desired criteria. The computer systems may poll the sensing devices or the sensing devices may transmit images and/or coordinates at any desired intervals for the tracing mode or sensing functions. The sensing devices may detect the laser beam continuously for any desired interval to initiate the tracing mode. The indicia for the tracing mode may be of any quantity, shape, size or color and may include any type of information. The tracing indicia may be placed at any locations and be incorporated into or overlaid with the target images. The tracing indicia may be flashing or continuously appearing on the display. The trace mode may display any quantity of previous impact locations to show movement of the firearm.

The systems may be configured for use with a transmitter emitting a laser beam having any desired pulse width, and may provide any type of message or other indication when the pulse width of a laser beam detected by the system is not compatible with the system configuration. The systems may be configured to detect and process beam impact locations at any desired shot rate. The systems may utilize any conventional or other techniques to convert between the various image spaces, and may compensate for any desired sensing device position and/or viewing angle. The systems may be utilized with targets scaled in any fashion to simulate conditions at any desired ranges, and may utilize lasers having sufficient power to be detected at any desired scaled range.

It is to be understood that the terms "top", "bottom", "side", "upper", "lower", "front", "rear", "horizontal", "vertical" and the like are used herein merely to describe points of reference and do not limit the present invention to any specific configuration or orientation.

The present invention is not limited to the applications disclosed herein, but may be utilized for any type of firearm training, qualification, competition, gaming or entertainment applications.

From the foregoing description, it will be appreciated that the invention makes available a novel firearm laser training system and method facilitating firearm training with various targets and visual feedback of simulated projectile impact locations wherein the system scans a target to determine locations of laser beam or simulated projectile impacts on the target and provides a display of the simulated impact locations on the target with information corresponding to user performance.

Having described preferred embodiments of a new and improved firearm laser training system and method of facilitating firearm training with various targets and visual feedback of simulated projectile impact locations, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A firearm laser training system enabling a user to project a laser beam toward a target to simulate firearm operation comprising:

a sensing device to scan said target to produce scanned images of said target including impact locations of said laser beam on said target; and a processor to process said scanned images including said impact locations, wherein said processor includes:

a density module to determine pixel density values for pixels within said scanned images, wherein said pixel density value for a scanned image pixel is determined by combining component pixel values for that pixel;

a detection module to identify said impact locations within said scanned images based on said pixel density values of pixels within said scanned images exceeding a threshold; and a threshold module to automatically adjust said threshold in response to measured light conditions of a surrounding environment.

2. The system of claim 1, wherein said component pixel values for each pixel within said scanned images include values associated with Red (R), Green (G) and Blue (B) pixel components, and said pixel density value for that pixel is determined by:

Pixel Density=(Red value×Weight1)+
(Green value×Weight2)+(Blue value×Weight3);

wherein Weight1, Weight2 and Weight3 are weighting values.

3. The system of claim 1, wherein said detection module includes a group location module to compare pixel density values of scanned image pixels to said threshold to identify a group of pixels within a scanned image where each group member pixel includes a pixel density value exceeding said threshold.

4. The system of claim 3, wherein said detection module further includes an impact location module to determine the scanned image pixel positioned at a center of said group and representing said impact location.

5. The system of claim 4, wherein said detection module further includes a coordinate module to determine coordinates of said pixel representing said impact location.

6. The system of claim 1, wherein said target includes a plurality of zones each representing an intended target site and associated with a score value, and said processor further includes:

a scoring module to determine impact scores, wherein each impact score is associated with a detected impact location and based on said score value of said zone containing that detected impact location.

7. The system of claim 1 further including a display to display an image of said target with indicia indicating said detected impact locations.

8. In a firearm simulation system enabling a user to project a laser beam toward a target and including a sensing device and a processor, a method of simulating firearm operation comprising:

(a) scanning said target with said sensing device to produce scanned images of said target including impact locations of said laser beam on said target; and (b) processing said scanned images including said impact locations via said processor, wherein said processing includes:

(b.1) determining pixel density values for pixels within said scanned images, wherein said pixel density value for a scanned image pixel is determined by combining component pixel values for that pixel;

(b.2) identifying said impact locations within said scanned images based on said pixel density values of pixels within said scanned images exceeding a threshold; and (b.3) automatically adjusting said threshold in response to measured light conditions of a surrounding environment.

9. The method of claim 8, wherein said component pixel values for each pixel within said scanned images include values associated with Red (R), Green (G) and Blue (B) pixel components, and step (b.1) further includes:

(b.1.1) determining said pixel density value for a scanned image pixel in accordance with:

Pixel Density=(Red value×Weight1)+
(Green value×Weight2)+(Blue value×Weight3);

wherein Weight1, Weight2 and Weight3 are weighting values.

10. The method of claim 8, wherein step (b.2) further includes:

(b.2.1) comparing pixel density values of scanned image pixels to said threshold to identify a group of pixels within a scanned image where each group member pixel includes a pixel density value exceeding said threshold.

11. The method of claim 10, wherein step (b.2) further includes:

(b.2.2) determining the scanned image pixel positioned at a center of said group and representing said impact location.

12. The method of claim 11, wherein step (b.2) further includes:

(b.2.3) determining coordinates of said pixel representing said impact location.

13. The method of claim 8, wherein said target includes a plurality of zones each representing an intended target site and associated with a score value, and step (b.2) further includes:

(b.2.1) determining impact scores, wherein each impact score is associated with a detected impact location and based on said score value of said zone containing that detected impact location.

14. The method of claim 8 further including:

(c) displaying an image of said target with indicia indicating said detected impact locations on a display.

15. A firearm laser training system enabling a user to project a laser beam toward a target to simulate firearm operation comprising:

a sensing device to scan said target to produce scanned images of said target including impact locations of said laser beam on said target; and a processor to process said scanned images including said impact locations, wherein said processor includes:

a density module to determine pixel density values for pixels within said scanned images, wherein said pixel density value for a scanned image pixel is determined by combining component pixel values for that pixel, and wherein said component pixel values for each pixel within said scanned images include values associated with Red (R), Green (G)

and Blue (B) pixel components, and said pixel density value for that pixel is determined by:

Pixel Density=(Red value×Weight1)+(Green value×Weight2)+(Blue value×Weight3), wherein Weight1, Weight2 and Weight3 are weighting values; and a detection module to identify said impact locations within said scanned images based on said pixel density values of pixels within said scanned images exceeding a threshold.

16. The system of claim 15, wherein said detection module includes a group location module to compare pixel density values of scanned image pixels to said threshold to identify a group of pixels within a scanned image where each group member pixel includes a pixel density value exceeding said threshold.

17. The system of claim 16, wherein said detection module further includes an impact location module to determine the scanned image pixel positioned at a center of said group and representing said impact location.

18. The system of claim 17, wherein said detection module further includes a coordinate module to determine coordinates of said pixel representing said impact location.

19. The system of claim 15, wherein said target includes a plurality of zones each representing an intended target site and associated with a score value, and said processor further includes:

a scoring module to determine impact scores, wherein each impact score is associated with a detected impact location and based on said score value of said zone containing that detected impact location.

20. The system of claim 15 further including a display to display an image of said target with indicia indicating said detected impact locations.

21. The system of claim 15, wherein said processor further includes:

a threshold module to automatically adjust said threshold in response to measured light conditions of a surrounding environment.

22. In a firearm simulation system enabling a user to project a laser beam toward a target and including a sensing device and a processor, a method of simulating firearm operation comprising:

(a) scanning said target with said sensing device to produce scanned images of said target including impact locations of said laser beam on said target; and (b) processing said scanned images including said impact locations via said processor, wherein said processing includes:

(b.1) determining pixel density values for pixels within said scanned images, wherein said pixel density value for a scanned image pixel is determined by combining component pixel values for that pixel, and wherein said component pixel values for each pixel within said scanned images include values associated with Red (R), Green (G) and Blue (B) pixel components, and step (b.1) further includes:

(b.1.1) determining said pixel density value for a scanned image pixel in accordance with:

Pixel Density=(Red value×Weight1)+(Green value×Weight2)+(Blue value×Weight3), wherein Weight1, Weight2 and Weight3 are weighting values; and (b.2) identifying said impact locations within said scanned images based on said pixel density values of pixels within said scanned images exceeding a threshold.

23. The method of claim 22, wherein step (b.2) further includes:

(b.2.1) comparing pixel density values of scanned image pixels to said threshold to identify a group of pixels within a scanned image where each group member pixel includes a pixel density value exceeding said threshold.

24. The method of claim 23, wherein step (b.2) further includes:

(b.2.2) determining the scanned image pixel positioned at a center of said group and representing said impact location.

25. The method of claim 24, wherein step (b.2) further includes:

(b.2.3) determining coordinates of said pixel representing said impact location.

26. The method of claim 22, wherein said target includes a plurality of zones each representing an intended target site and associated with a score value, and step (b.2) further includes:

(b.2.1) determining impact scores, wherein each impact score is associated with a detected impact location and based on said score value of said zone containing that detected impact location.

27. The method of claim 22 further including:

(c) displaying an image of said target with indicia indicating said detected impact locations on a display.

28. The method of claim 22, wherein step (b) further includes:

(b.3) automatically adjusting said threshold in response to measured light conditions of a surrounding environment.

* * * * *